US010575585B2

(12) United States Patent
Kirk et al.

(10) Patent No.: US 10,575,585 B2
(45) Date of Patent: Mar. 3, 2020

(54) SUPPORTING ELEMENT FOR SHOES

(71) Applicant: adidas AG, Herzogenaurach (DE)

(72) Inventors: Robert Frank Kirk, Herzogenaurach (DE); Daniel Stephen Price, Herzogenaurach (DE); Harald Körger, Herzogenaurach (DE); Constantin Zwick, Herzogenaurach (DE); John Whiteman, Herzogenaurach (DE); Iain James Sabberton, Herzogenaurach (DE); Peter Georg Laitenberger, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/677,106

(22) Filed: Apr. 2, 2015

(65) Prior Publication Data

US 2015/0282557 A1 Oct. 8, 2015

(30) Foreign Application Priority Data

Apr. 3, 2014 (DE) ..... 10 2014 206 419

(51) Int. Cl.
*A43B 3/00* (2006.01)
*A43B 5/02* (2006.01)
(Continued)

(52) U.S. Cl.
CPC ..... *A43B 13/141* (2013.01); *A43B 3/0047* (2013.01); *A43B 5/02* (2013.01); *A43B 13/183* (2013.01)

(58) Field of Classification Search
CPC ..... A43B 3/0047; A43B 5/02; A43B 13/14; A43B 13/141; A43B 13/181; A43B 13/183; A43B 13/185
(Continued)

(56) References Cited

U.S. PATENT DOCUMENTS 1,466,384 A 8/1923 Sechler
4,476,638 A * 10/1984 Quacquarini ..... A43B 7/28 36/103
(Continued)

FOREIGN PATENT DOCUMENTS

CN 101365356 2/2009
CN 102112022 6/2011
(Continued)

OTHER PUBLICATIONS

European Application No. 15161632.3, European Search Report dated Sep. 25, 2015, 6 pages.
(Continued)

*Primary Examiner* — Sharon M Prange
(74) *Attorney, Agent, or Firm* — Kilpatrick Townsend & Stockton LLP

(57) ABSTRACT

Described are supporting elements for a shoe, in particular for soccer shoes or American football shoes, as well as a sole and a shoe with a supporting element. The supporting element includes a first bending stiffness for bendings from an initial unbent state up to an upper end of a threshold angle range, and a second bending stiffness for bendings beyond the upper end of the threshold angle range, wherein the second bending stiffness is greater than the first bending stiffness.

18 Claims, 13 Drawing Sheets

(51) Int. Cl.
*A43B 13/14* (2006.01)
*A43B 13/18* (2006.01)

(58) Field of Classification Search
USPC ..... 36/25 R, 102, 107, 128
See application file for complete search history.

(56) References Cited

U.S. PATENT DOCUMENTS

| | | | | |
|---|---|---|---|---|
| 4,779,361 | A * | 10/1988 | Kinsaul | A43B 13/16 36/102 |
| 6,516,539 | B2 * | 2/2003 | Nishiwaki | A43B 7/144 36/28 |
| 6,954,998 | B1 | 10/2005 | Lussier | |
| 7,082,702 | B2 * | 8/2006 | Cretinon | A43B 13/026 36/107 |
| 7,832,117 | B2 | 11/2010 | Wachtel et al. | |
| 8,074,377 | B2 * | 12/2011 | Nishiwaki | A43B 7/142 36/25 R |
| 8,312,647 | B2 * | 11/2012 | Hofmann | A43C 15/161 36/103 |
| 8,418,379 | B2 | 4/2013 | Nishiwaki et al. | |
| 8,549,774 | B2 * | 10/2013 | Meschter | A43B 5/12 36/102 |
| 8,872,362 | B2 * | 10/2014 | Lee | A43B 3/0015 290/1 A |
| 2004/0111920 | A1 | 6/2004 | Cretinon | |
| 2010/0154258 | A1 | 6/2010 | Scholz et al. | |
| 2012/0096746 | A1 | 4/2012 | Lee et al. | |
| 2014/0000131 | A1 | 1/2014 | Meschter et al. | |

FOREIGN PATENT DOCUMENTS

| | | |
|---|---|---|
| CN | 102892323 | 1/2013 |
| CN | 102946750 | 2/2013 |
| CN | 104379011 | 2/2015 |
| DE | 1973891 | 11/1967 |
| WO | 2004021819 | 3/2004 |
| WO | 2009106077 | 9/2009 |
| WO | 2010121709 | 10/2010 |
| WO | 2014155707 | 10/2014 |

OTHER PUBLICATIONS

German Application No. 102014206419.8, Office Action dated Jan. 8, 2015, 6 pages. (No English translation available. See summary of the Office Action in the Transmittal Letter submitted herewith).

Chinese Application No. 201510158462.0, Office Action dated Apr. 21, 2016, 5 pages. (No English translation available. A summary of the Office Action is provided in the Transmittal Letter submitted herewith).

Chinese Application No. 201510158462.0, Office Action dated Jan. 13, 2017, 6 pages (No English translation available. A summary of the Office Action is provided in the Transmittal Letter submitted herewith).

German Patent Application No. 102014206419.8, Office Action dated Nov. 20, 2017, 11 pages (5 pages of English translation and 6 pages of original document).

Japanese Patent Application No. 2015-071580, Office Action dated Jan. 29, 2018, 6 pages (3 pages of English translation and 3 pages of original document).

European Patent Application No. 15161632.3, Office Action dated Jul. 19, 2017, 6 pages.

German Patent Application No. DE 102014206419.8, "Office Action", dated Aug. 16, 2019, 9 pages (5 pages of translation and 4 pages of Original document).

* cited by examiner

SUPPORTING ELEMENT FOR SHOES

CROSS REFERENCE TO RELATED APPLICATION

This application is related to and claims priority benefits from German Patent Application No. DE 10 2014 206 419.8, filed on Apr. 3, 2014, entitled SUPPORTING ELEMENT FOR SHOES ("the '419 application"). The '419 application is hereby incorporated herein in its entirety by this reference.

FIELD OF THE INVENTION

The present invention relates to a supporting element for shoes, in particular for soccer shoes or American football shoes, as well as a sole and a shoe with a supporting element.

BACKGROUND

Nowadays, shoes are provided with a plethora of different properties and are often manufactured from different shoe parts. Depending on the specific kind of shoe and the parts used for the manufacture, these properties may be pronounced to different degrees.

Shoe soles, for example, primarily comprise a protective function. Furthermore, the outsole usually protects the midsole of a shoe by an increased abrasion resistance from excessive wear. A shoe sole may also have a cushioning effect, for example to cushion or absorb the forces occurring during contact between the shoe and the ground. Furthermore, a shoe sole can protect the foot from dirt or spray water.

A further function of a shoe sole may be to increase the traction or grip of a shoe on the respective ground in order to facilitate faster movements and to minimize the risk of the wearer falling.

In particular for ball sports, like e.g. soccer, American football, baseball or basketball, but also for running sports, there is often a change between movements in different intensity and strain ranges during the course of the game or run. On the one side, movements are implied with a lower intensity, e.g. running, trotting or jogging slowly, etc., for which the athlete does not have to expend overly large forces. However, such movements are typically performed over a longer period of time. On the other hand, however, phases of high movement intensity are also often part of a game, e.g. a soccer game, an American football game, a baseball game or a basketball game, or part of a run, like e.g. a cross-country run or a mountain run, for example during a sprint, while jumping, during sudden changes of direction, during mountain running, and so forth. Typically, the different intensity ranges also imply characteristic movement patterns, which may sometimes differ from each other significantly.

Given this background, the shoes known from the prior art are typically intended for a single field of application and are adapted to the respective characteristic movement pattern.

Therefore, it may be desirable to provide a supporting element, a sole and a shoe, which can dynamically adapt to the changing requirements that result from the change between movements in different intensity ranges.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a supporting element for a shoe comprises a first bending stiffness for bendings from an initial unbent state up to an upper end of a threshold angle range; and a second bending stiffness for bendings beyond the upper end of the threshold angle range, wherein the second bending stiffness is greater than the first bending stiffness.

In some embodiments, the threshold angle range is approximately 10° to 30° measured relative to the initial unbent state. A ratio of the second bending stiffness to the first bending stiffness may be approximately 1.1:1 to 4:1.

According to some embodiments, the first bending stiffness and the second bending stiffness each correlate to a bending stiffness of the supporting element along a roll-off direction of a wearer's foot. The supporting element may be provided to support the front half of a wearer's foot.

In certain embodiments, the threshold angle range is a first threshold angle range, and wherein the supporting element is further provided such that it comprises a third bending stiffness, which is greater than the second bending stiffness, for bendings beyond an upper end of a second threshold angle range, and wherein the second threshold angle range extends across larger angles, measured relative to the initial unbent state, than the first threshold angle range.

According to some embodiments, the supporting element comprises at least one of spring steel, polyoxymethylene, polyamide, and glass fibers.

Certain embodiments may comprise a sole for a shoe with a supporting element as described above. Further embodiments may comprise a shoe with such a sole.

According to certain embodiments of the present invention, a supporting element for a shoe comprises a bending system that comprises a first bending stiffness for bendings from an initial unbent state up to an upper end of a threshold angle range, and a second bending stiffness and an additional tensile stress for bendings beyond the upper end of the threshold angle range, wherein the second bending stiffness is greater than the first bending stiffness.

In some embodiments, the bending system comprises a first bending element and a second bending element, which are arranged such that they engage with each other for the bendings beyond the upper end of the threshold angle range in order to create the additional tensile stress.

The first bending element may comprise at least one protrusion that is arranged in a recess of the second bending element and that abuts on an edge of the recess in a force-fit manner for the bendings beyond the upper end of the threshold angle range. The first bending element and the second bending element may be provided as two flexible metal plates.

In some embodiments, the bending system comprises a first securing device and a second securing device, wherein the first securing device is arranged such that it prevents a movement of the bending system relative to the first securing device, and wherein the second securing device is arranged such that it allows a movement of the bending system relative to the second securing device for a bending up to the upper end of the threshold angle range and prevents the movement for the bendings beyond the upper end of the threshold angle range and thus creates the additional tensile stress in the bending system.

According to some embodiments, the second securing device is arranged within an opening in the bending system such that it can move substantially freely within the opening for a bending up to the upper end of the threshold angle range and that a further movement is prevented by an edge of the opening for bendings beyond the upper end of the threshold angle range. The opening in the bending system may be provided as an elongated hole.

In certain embodiments, the bending system comprises a rope element, wherein the rope element is subject to a first tensile stress for bendings up to the upper end of the threshold angle range, and wherein the rope element is subject to a second tensile stress, which is greater than the first tensile stress, for bendings beyond the upper end of the threshold angle range. In these embodiments, the first tensile stress may be 0.

According to certain embodiments of the present invention, a supporting element for a shoe comprises a bending system that comprises a first bending stiffness for bendings from an initial unbent state up to an upper end of a threshold angle range, and a second bending stiffness and an additional compressive stress for bendings beyond the upper end of the threshold angle range, wherein the second bending stiffness is greater than the first bending stiffness.

In certain embodiments, the bending system comprises a first pressure element and a second pressure element that are arranged such that they are pressed onto each other for the bendings beyond the upper end of the threshold angle range in order to create the additional compressive stress.

BRIEF DESCRIPTION OF THE DRAWINGS

In the following detailed description, embodiments of the invention are described referring to the following figures.

BRIEF DESCRIPTION

Figure 1A:
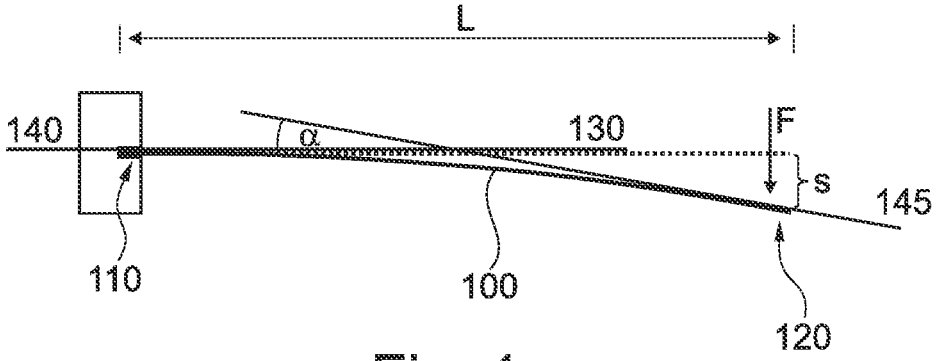
FIGS. 1*a-c* are illustrations of the meaning of the parameters used in this document.

According to a first aspect of the present invention, this problem is at least partially solved by a supporting element for a shoe, in particular a soccer shoe or an American football shoe, wherein the supporting element is provided such that it comprises a first bending stiffness for bendings from an initial unbent state up to an upper end of a threshold angle range and comprises a second bending stiffness for bendings beyond the upper end of the threshold angle range, wherein the second bending stiffness is greater than the first bending stiffness.

For movements of lower intensity, like for example running, trotting or jogging slowly, it is characteristic that in the region of the metatarsophalangeal joints (MTP joints), also called toe base joints, only a slight hinging occurs. It is important for such movements that roll-off of the foot may proceed as naturally as possible. It may be desirable if as little energy as possible is absorbed by the sole and hence withdrawn from the athlete. In general, one can say that in these intensity ranges a comfortable and energy-saving way of running is of primary importance, and the natural movement patterns shall preferably be maintained. This is ensured by embodiments of the supporting element comprising a first, lower bending stiffness for bendings from an initial unbent state up to an upper end of a threshold angle range such that it only insignificantly influences the natural flow of movements.

Meanwhile, for phases of high movement intensity, it is characteristic that the athlete has to transfer very high forces, in particular push-off forces, to the ground in a short time. The better the transfer of forces from the athlete to the ground is, the faster he can run or change direction, the higher he can jump, and so forth. It is characteristic for such movements that the foot is strongly hinged in the MTP joints and the transfer of forces predominantly occurs via the forefoot. This hinging is further intensified, in particular during fast running or sprinting, by the posture of the athlete being tilted in the forward direction. In order to ensure as large a transfer of forces as possible, the foot must not yield to the forces acting in such a situation, since otherwise the forces will "come to nothing."

This means that the muscles of the athlete, in particular the foot muscles and the calf muscles, have to ensure that the above-mentioned angle in the region of the MTP joints is maintained and at the same time ensure as strong a push-off of the foot from the ground as possible. This results in a significant load on the respective muscle groups. It is therefore desirable for such movement phases that the sole provides for improved support, in order to relieve the supporting muscles of the athlete and to improve traction between the foot and the ground. This is also facilitated by embodiments of the supporting element as it comprises a second bending stiffness, which is greater than the first bending stiffness, for bendings beyond the upper end of the threshold angle range and hence supports the foot during push-off as just explained.

A number of technical realizations and embodiments of the supporting element as just described may be employed, of which several will be described in the following. Reference is, however, already at this point made to the fact that the supporting element cannot be restricted to the embodiments explicitly described herein.

In some embodiments, the threshold angle range extends from 10° to 30°, wherein the bending angle is measured relative to an initial unbent state. The threshold angle range may further extend from 15° to 25°, and may yet further extend from 18° to 22°.

It was found that the transition between movements of lower intensity and higher intensity in the sense discussed above typically occurs for flex angles in the foot region, in particular in the region of the MTP joints, in these ranges of angles, such that it may be desirable if the supporting element transitions in these ranges of angles from its "soft phase," in which it comprises the first bending stiffness, to its "stiff phase," in which it comprises the second, larger bending stiffness.

In certain embodiments, a ratio of the second bending stiffness to the first bending stiffness may be the range from 1.1:1 to 4:1, may further be in the range from 1.2:1 to 3:1, and may yet further be in the range from 2:1 to 2.4:1.

Such a ratio of the bending stiffnesses represents an optimal compromise between providing for the above discussed, desirable roll-off and supporting function of a shoe with such a supporting element on the one side, and the general functionality and the wearing comfort of such a shoe on the other side.

In some embodiments, in the threshold angle range, both a continuous change of the bending stiffness of the supporting element as well as a stepwise change occurs. More detailed explanations to this point will follow below in the context of the discussion of the various embodiments.

By a suitable choice of the threshold angle range and the ratio of the first bending stiffness to the second bending stiffness, the behavior of the supporting element may further be individually adapted to the respective requirements. Such different requirements will be explained further below in the detailed description in relation to FIGS. 12*a-b* in more detail.

In this context, the first bending stiffness and the second bending stiffness, for example, each correlates to a bending stiffness of the supporting element along a roll-off direction of the foot. In some embodiments, the supporting element is provided to support the front half of the foot, in particular the region of the MTP joints.

As already explained, the hinging of the MTP joints represents a decisive criterion for the transition between the different intensity ranges of the movements of an athlete, such that a supporting element can react to a change in the hinging by adjusting its bending stiffness along a roll-off direction of the foot and support the foot at high intensities in this region.

In some embodiments, the supporting element has a supporting effect in other regions, for example in the mid-foot region or the heel region, or that the bending stiffness designates the bending stiffness with respect to another direction, for example the medial-lateral direction.

In certain embodiments, the supporting element comprises a bending system that is provided such that for a bending of the bending system beyond the upper end of the threshold angle range, an additional tensile stress is created within the bending system and that the bending stiffness is thus increased.

A bending moment acting on the bending system for bendings beyond the upper end of the threshold angle range can for example be translated into an additional tensile stress that acts on the bending system. The additional tensile stress in the bending system creates a restoring force, which counteracts a further bending of the bending system and thus increases the bending stiffness of the bending system for bendings beyond the upper end of the threshold angle range. By the choice of the material for the bending system, the additional tensile stress or the increase in bending stiffness thus achieved may be influenced.

In some embodiments, the energy exerted by creating the tensile stress during bending of the bending system is at least partially returned again as soon as the bending angle decreases again. This can further facilitate the movement of the athlete.

It is further possible that the bending system comprises a first bending element and second bending element that are arranged such that they engage with each other for bendings beyond the upper end of the threshold angle range in order to create the additional tensile stress.

For bendings up to the upper end of the threshold angle range, the first bending element and the second element can slide with respect to each other or otherwise move freely or mostly unhampered. For bendings beyond the upper end of the threshold angle range, on the other hand, the first and the second bending elements engage with each other. This prevents or hampers further movement, resulting in a tensile stress in the first and/or the second bending element. This tensile stress can in turn increase the bending stiffness of the bending system as described above.

The first bending element may comprise at least one protrusion that is arranged in a recess of the second bending element and abuts in a force-fit manner on an edge of the recess for the bendings beyond the upper end of the threshold angle range. Herein, the protrusion may in particular move freely within the recess for bendings up to the upper end of the threshold angle range.

This represents embodiments of such a bending system with a simple and simultaneously robust construction. In addition, such embodiments may allow achieving a clearly noticeable difference between the first bending stiffness and the second bending stiffness.

Herein, it is in particular possible that the first and the second bending elements are provided as two flexible metal plates. In certain embodiments, for example, metal plates may be made from spring steel. The first and the second bending elements may also be manufactured from a plastic material or they may at least comprise a plastic material. Compared to a metal, a plastic may in particular be light-weight and very inexpensive in the manufacture, and plastics may even be more stable with respect to bendings than a metal.

Metal plates may be desirable in certain embodiments, in that they may be manufactured very thin and, if desired, flexible, such that the bending stiffness for bendings up to the upper end of the threshold angle range may be maintained low. At the same time, metal plates comprise a very high stability and tensile strength.

On the one hand, in some embodiments, the first bending element and the second bending element may be arranged next to each other, for example on a bottom side of a mid- or insole plate. On the other side, however, the first bending element and the second bending element may be arranged on top of each other.

In some embodiments, the bending system comprises a first securing device and a second securing device, wherein the first securing device is arranged such that it prevents a movement of the bending system relative to the first securing device, and wherein the second securing device is arranged such that it allows a movement of the bending system relative to the second securing device for a bending up to the upper end of the threshold angle range and prevents the movement for the bendings beyond the upper end of the threshold angle range and thus creates a tensile stress in the bending system.

This represents a further possibility to increase the bending stiffness of the bending system for bendings beyond the upper end of the threshold angle range. In some embodiments, this design possibility is used in combination with the first bending element and the second bending element described above.

The second securing device may be arranged within an opening in the bending system such that it can move substantially freely within the opening for a bending up to the upper end of the threshold angle range and that a further movement is prevented by an edge of the opening for bendings beyond the upper end of the threshold angle range. In some embodiments, the opening in the bending system is provided as an elongated hole.

Within this document, a substantially free movement means a movement where only small friction forces occur that are unavoidable due to the construction.

This represents a possibility for providing embodiments of an supporting element with a particularly simple construction. The first and the second securing device may for example be rivets or screws that connect the bending system with an insole plate, for example made of plastic, metal, a foam material, or something similar.

In some embodiments, the bending system comprises a rope element, wherein the rope element is subject to a first tensile stress for bendings up to the upper end of the threshold angle range and wherein the rope element is subject to a second tensile stress, which is greater than the first tensile stress, for bendings beyond the upper end of the threshold angle range.

This, too, represents a possibility for providing embodiments of the supporting element with a simple construction which in addition may be provided very space-saving. Further, via the tensile strength of the rope, the bending stiffness of the supporting element may be influenced in a simple manner.

Herein, the first tensile stress is for example zero. That is, the rope element is initially arranged at the bending system without any stress. The rope element is subject to a tensile stress only for bendings of the supporting element or the bending system, respectively, beyond the upper end of the threshold angle range, leading to an increase of the bending stiffness of the bending system. Hence, the bending stiffness of the bending system for bendings beyond the upper end of the threshold angle range may be influenced by a suitable choice of the material parameters of the rope element directly and in a particularly easy manner.

In further embodiments, the supporting element comprises a bending system that is provided such that for the bendings beyond the upper end of the threshold angle range, an additional compressive stress is created within the bending system and the bending stiffness is thus increased.

Here, then, a compressive stress counteracts a further bending of the bending system as a restoring force for bendings beyond the upper end of the threshold angle range, leading to an increase of the bending stiffness of the bending system for such bendings.

In some embodiments, the energy exerted by creating the compressive stress when bending the bending system is at least partially returned as soon as the bending angle decreases again. This may further facilitate movements in a desirable manner.

In some embodiments, the bending system comprises a first pressure element and a second pressure element that are arranged such that they are pressed onto each other for bendings beyond the upper end of the threshold angle range in order to create the additional compressive stress.

Such a supporting element may for example be employed in a shoe sole. In some embodiments, such a supporting element is arranged on a shoe upper, for example in the region of the instep or the tongue, or something similar.

The threshold angle range mentioned so far may for example be a first threshold angle range and the supporting element may further be provided such that it comprises a third bending stiffness, which is greater than the second bending stiffness, for bendings beyond an upper end of a second threshold angle range and wherein the second threshold angle range, measured relative to the initial unbent state, extends across larger angles as the first threshold angle range.

This allows an even more detailed and selective adjustment of the bending stiffness of the supporting element to the different loads, movement phases, and movement patterns of the wearer in several "stiffness stages."

It is possible that the supporting element comprises at least one of the following materials: metals, plastics, in particular spring steel, polyoxymethylene, polyamide, glass fibers.

As already mentioned, spring steel may be desirable in certain embodiments because it may be provided very thin and, if desired, also flexible, while still comprising a high stability and tensile strength. The other mentioned materials also comprise their own desirable properties for providing embodiments of the supporting element, for example a low weight, good workability, and so forth.

A further aspect of the present invention is provided by a sole for a shoe, in particular a sole for soccer shoe or an American football shoe, with the supporting element.

As already mentioned, however, in some embodiments, the supporting element may be used in connection with a shoe upper.

The invention further comprises a shoe, in particular a soccer shoe or an American football shoe, with such a sole or such a shoe upper.

For embodiments of soles, shoe uppers and shoes, several of the properties and design options of an supporting element disclosed herein may be combined with one another, according to the existing specific requirements. Also, individual aspects may be disregarded as far as they seem dispensable for the intended use, without the resulting embodiment no longer being part of the invention.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, some possible embodiments of the invention are described with reference to sports shoes, in particular soccer shoes and American football shoes. It is, however, emphasized that the present invention is not limited to these embodiments. Rather, the present invention may for example also be applied to baseball shoes, basketball shoes or running shoes, as well as working shoes, leisure shoes, trekking shoes, golf shoes and different kind of shoes.

Figure 1B:
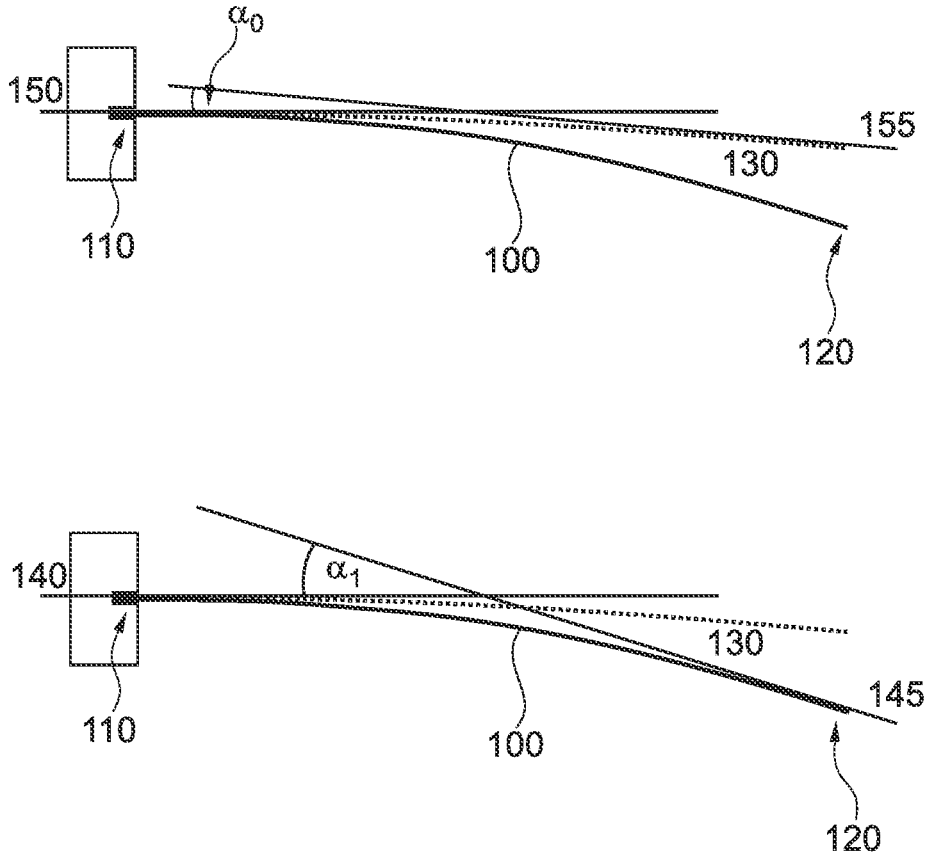
Figure 1C:
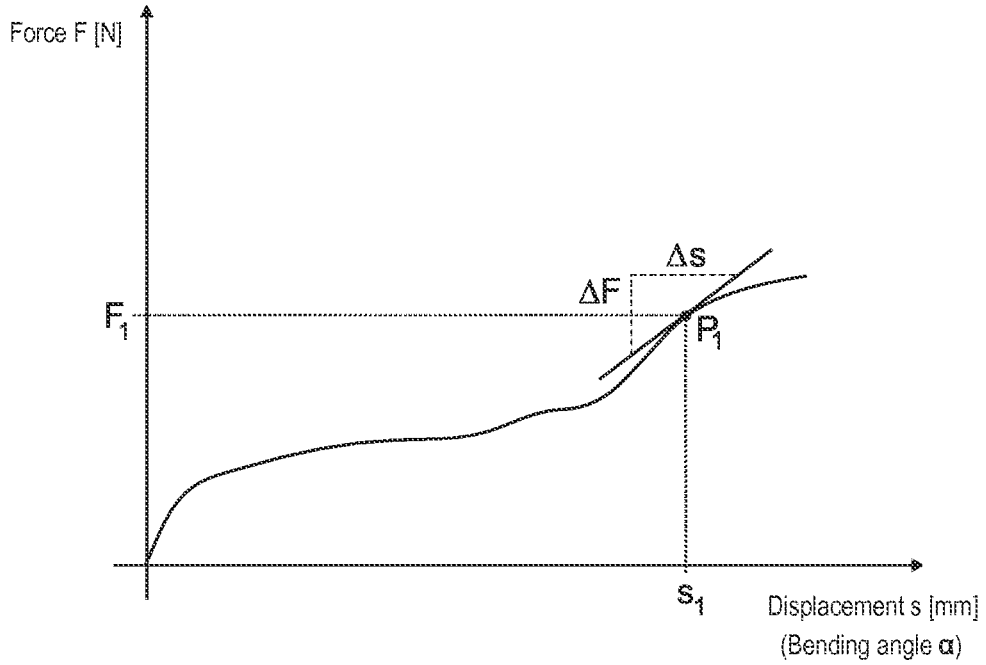

FIGS. 1*a-c* are provided as visual support for the terms and parameters used herein. FIG. 1*a* shows a flexible component 100 whose one end 110 is fixedly clamped. The component 100 comprises the length L. If a force F acts on the free end 120 of the component 100, it creates a bending moment and this in turn leads to a bending of the component 100 and hence the displacement of the free end 120 by the distance s. The reference point for the measurement of the displacement s is the position of the component 100 in the force-free state which is indicated by the dashed line 130 in FIG. 1*a*. As the bending angle of a component 100, for example the angle a, which is given by the angle of intersection of the tangent 140 to the one end 110 of the component 100 with the tangent 145 to the other end 120 of the component 100, may be understood. As the skilled person will understand, for a given length L of the component 100, there is a unique relationship between bending angle a and displacement s, such that the displacement s and the bending angle a may be used synonymously. The exact relationship between a and s may be determined from a series of measurements, is necessary. The displacement s or the bending angle a, respectively, will depend on the acting force F. This dependency is influenced by the bending stiffness of the component 100. An even more detailed definition of the bending stiffness follows below with reference to FIG. 1*c*.

FIG. 1*b* illustrates the case that the component 100 comprises a curvature $a_0$ already in the force-free state, indicated by the dashed line 130, which is given by the angle of intersection of the tangent 150 to the first end 110 of the component 100 in the force-free state 130 with the tangent 155 to the second end 120 of the component 100 in the force-free state 130, similar to the case above. If a force now acts on the end 120, this leads to a bending of the component 100 which leads to an angle $a_1$ between the tangents 140 and 145. In such a case, the difference between the two angles of intersection of the tangents in the loaded and in the unloaded state may be understood as the bending angle $a{:}a=a_1-a_0$.

It is entirely clear for the skilled person, that FIGS. 1*a-b* merely serve the purpose of providing visual support for the meaning of the parameters used in this document. Of course, for embodiments of the supporting element, the one end will not fixedly be clamped to a wall or a fixation device like a vise as shown in FIGS. 1*a-b* during the intended use. However, such an arrangement represents an exemplary possibility for measuring the relevant parameters and properties that may also be used for performing measurements on embodiments of the supporting element.

FIG. 1*c* shows a hypothetical measurement curve resulting from such a measurement performed on a flexible component 100. On the x-axis, the displacement s of the end 120 of the component 100 is plotted, which results from the force F acting on the component 100. This force F is plotted on the y-axis. As already mentioned, for a given component, there is a unique relationship between the displacement s and the bending angle a, such that the x-value also represents a measure for the bending angle a.

The bending stiffness may now be a measure for what force is necessary in order to achieve a further bending of the component by a predetermined bending angle, for example by 0.1° or by 1° or the like. The force necessary for this can potentially depend on the degree of bending already present in the component. In the context of this document, the "differential" bending stiffness may therefore be implied. More precisely this means: the bending stiffness may designate the slope $\Delta F/\Delta s$ of the tangent on the displacement-force-curve of the component 100 in a given state $P_1$ $(s_1, F_1)$ and not, for example, the ratio of the absolute values $F_1/s_1$.

FIGS. 2*a-e* show embodiments of a supporting element 200. The supporting element 200 is provided such that it comprises a first bending stiffness for bendings from an initial unbent state up to an upper end of a threshold angle range and that it comprises a second bending stiffness, which is greater than the first bending stiffness, for bendings beyond the upper end of the threshold angle range. In the embodiments shown in FIGS. 2*a-e*, the first bending stiffness and the second bending stiffness each correlates to a bending stiffness in the longitudinal direction of the supporting element 200, i.e. in the roll-off direction of the foot. The supporting element 200 comprises a bending system 205. In the embodiments shown here, the supporting element 200 further comprises an insole plate 250 on which the bending system 205 is arranged. Further, in these embodiments of a supporting element 200, the bending system 205 is arranged on the insole plate 250 in such a manner that the supporting element 200 is provided to support the front half of the foot, in particular the region of the MTP joints. This can for example be particularly desirable in sports shoes, in order to guard against injuries of a wearer and to further increase his performance and endurance.

As already mentioned, it is characteristic for movements of lower intensity, like for example running, trotting or jogging slowly, that in the region of the MTP joints, also called toe base joints, only a slight hinging occurs. It is important for such movements that roll-off of the foot can proceed as naturally as possible.

On the other hand, for phases of high movement intensity, it is characteristic that the athlete has to transfer very large forces, in particular push-off forces, to the ground in a short time. The better the transfer of forces from the athlete to the ground is, the faster he can run or change direction, the higher he can jump, and so forth. It is characteristic for such movements that the foot is strongly hinged in the MTP joints and that the transfer of forces predominantly proceeds via the forefoot. In order to ensure as large a transfer of forces as possible, the foot must not yield to the forces acting, since these forces might otherwise "come to nothing." This means that the muscles of the athlete, in particular the foot muscles and the calf muscles, have to ensure that the above-mentioned angle in the region of the MTP joints is maintained and at the same time ensure as strong a push-off of the foot from the ground as possible. This leads to a significant load on the respective muscle groups.

Figure 12A:
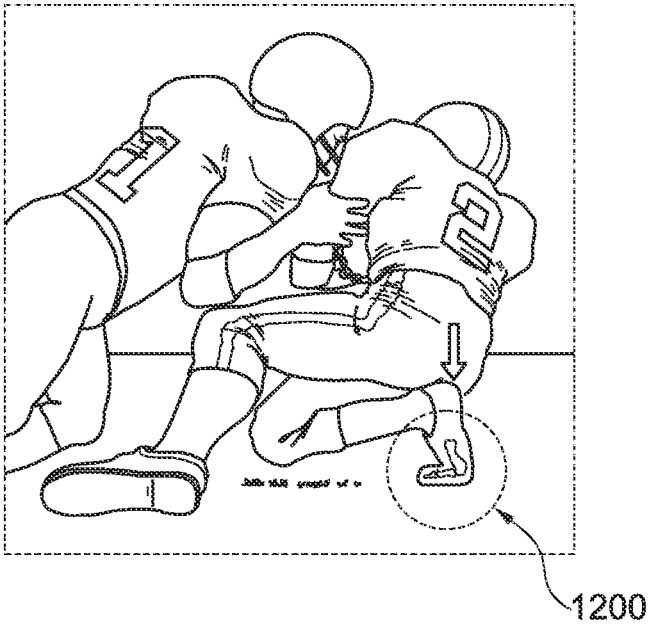
FIGS. 12*a-b* are views illustrating the hinging of the forefoot region during different movement patterns and the resulting risk of injury.
Figure 12B:
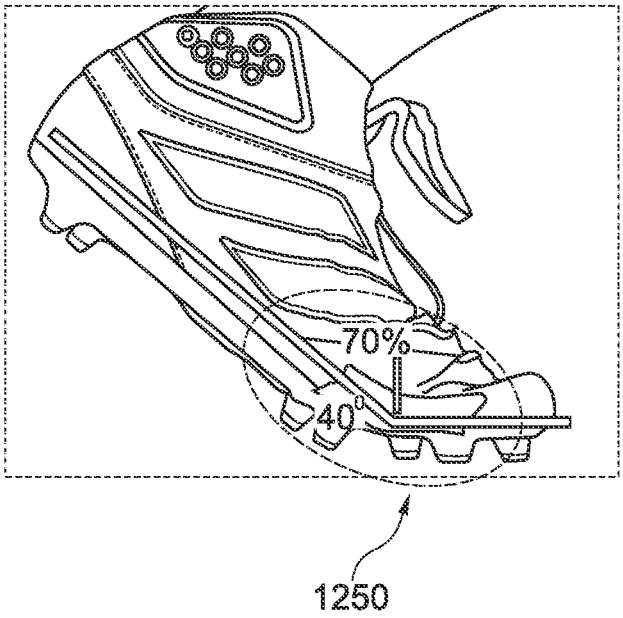

For example, in FIGS. 12*a-b*, snapshots of two different situations/movement patterns that are characteristic for certain sporting activities are depicted.

FIG. 12*a* shows a situation of high intensity, as it might occur for example during an American football game. The player shown on the right-hand side of the picture supports himself on his right foot in such a manner that a strong hinging and therefore a very high load on the MTP joints results, see 1200. In the example shown here, the angle amounts to approximately 90°, caused by the deep "squatting position" of the athlete. This implies a significant potential for injury of the MTP joints and the foot bones and tendons. In embodiments of a supporting element, it may be ensured by a suitable choice of the threshold angle range, for example in the range from 60° to 90° or 60° to 75° or something similar, that the foot of the player obtains additional support in such situations, such that the acting forces must not be absorbed by the musculoskeletal system of the athlete only. Moreover, a hinging for example beyond 90° may be prevented or at least impeded. To this end, the second bending stiffness for bendings beyond the upper end of the threshold angle range may for example be chosen significantly greater than the first bending stiffness. This may significantly reduce the risk of injury.

FIG. 12*b*, on the other hand, shows the foot of an athlete during running. In some embodiments, the angle in the region of the MTP joints, see 1250, is significantly smaller than in FIG. 12*a*. In FIG. 12*b*, the angle amounts to approximately 40°. The skilled person will understand that it will for example depend on the velocity of the runner as to how large this hinging angle will maximally be during a movement cycle. For running or walking slowly, the angle may for example not become greater than 20° or 30°. When running faster, the angle can reach for example 40° or more, as shown here. By a suitable choice of the threshold angle range, the bending stiffness of embodiments of the supporting element may on the one side be individually adjusted to the conditions and movement patterns predominant in a specific kind of sport in order to support the foot as well as possible and to guard against injuries. On the other hand, the first and second bending stiffness and/or the choice of the threshold angle range may be made such that the natural course of movements is impeded as little as possible, or even actively facilitated.

The insole plate 250 may for example be made from a plastic material. Further, the insole plate 250 typically comprises a bending stiffness that is largely independent from the bending angle of the supporting element 200. The insole plate 250 comprises for example at least one of the following materials, which are particularly well suited for the manufacture of such an insole plate 250: VESTAMID® LX9012, spring steel 301 0.5 H or WNr. 1.4310 (X10CrNi18-8) [=301 0.5 H according to AISI norm] obtainable from HER CHANG TECHNOLOGY CO., LTD.

It is, however, to be noted that the insole plate 250 is not necessarily part of every embodiment of the supporting element. Rather, the bending system 205 may also be used in embodiments of the supporting element or a sole or a shoe without an insole plate 250. The bending system 205 may for example be arranged directly on a midsole layer or an outsole layer or something similar.

The bending system 205 is provided such that an additional tensile stress is created in the bending system 205 for bendings beyond the upper end of the threshold angle range and that the bending stiffness is thus increased. In the embodiments shown here, this additional tensile stress is created in two different ways:

On the one hand, the bending system 205 comprises a first bending element 210 and a second bending element 220. In the embodiments of a bending system 205 shown here, they are provided as two flexible metal plates. However, in other embodiments, the supporting element 200 and in particular the bending elements 210 and 220 comprise at least one different material, such as plastic materials, for example polyoxymethylene or polyamide, and/or glass fibers.

Figure 2A:
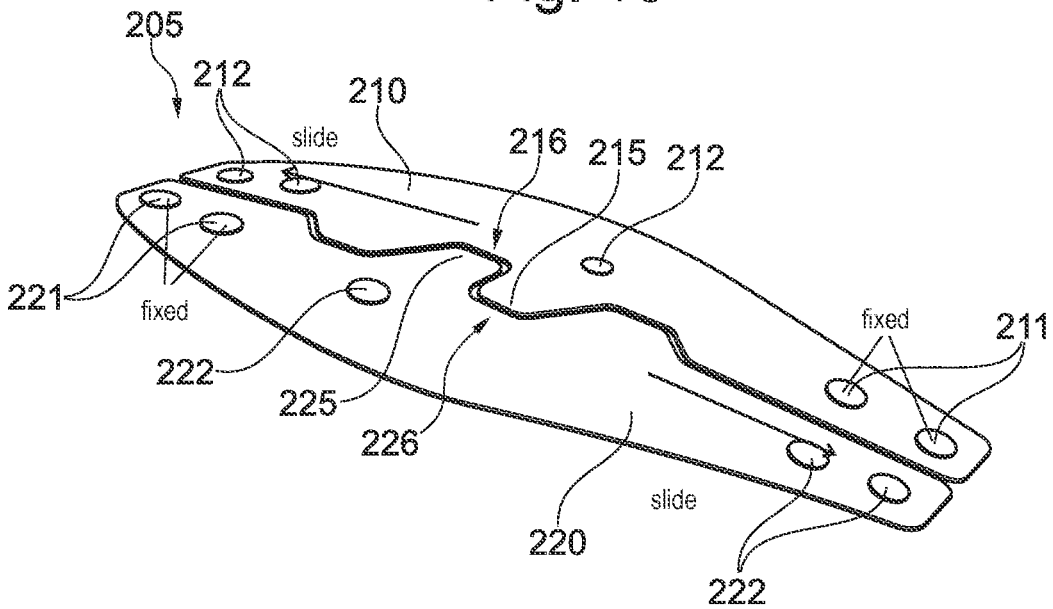
FIGS. 2*a-e* are views of a supporting element with a bending system, according to certain embodiments of the present invention.
Figure 2B:
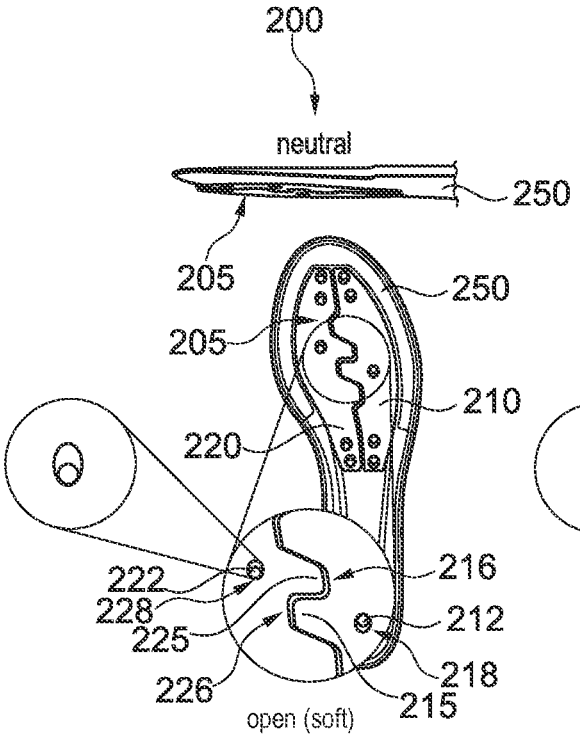
Figure 2C:
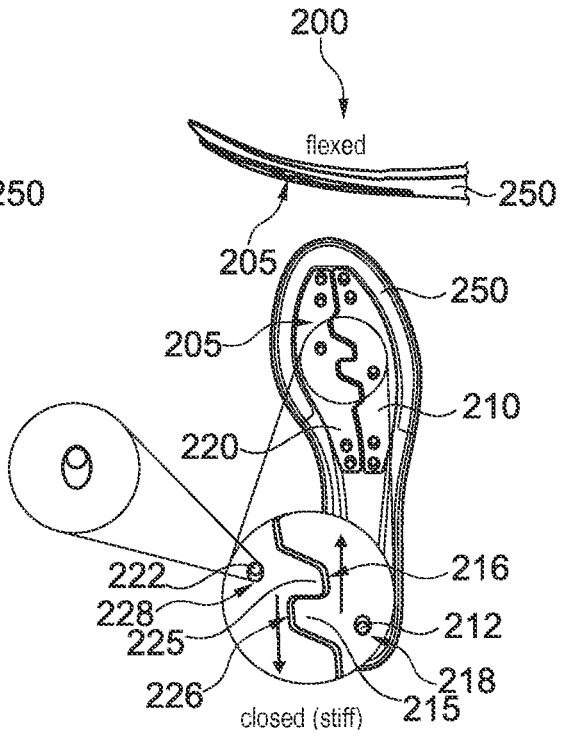
Figure 2D:
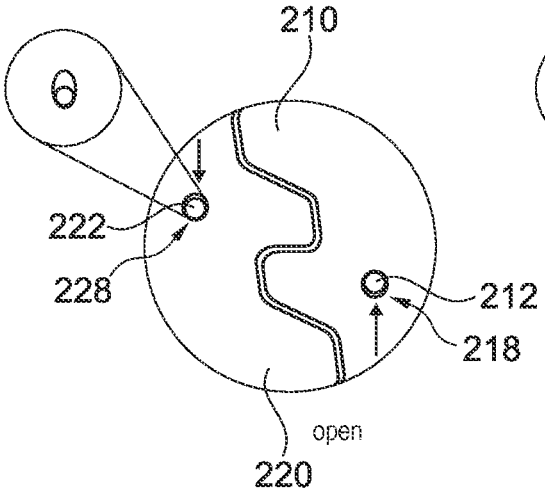
Figure 2E:
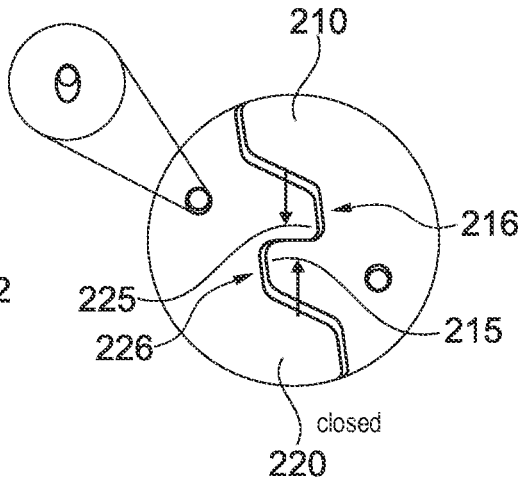

The first bending element 210 and the second bending element 220 are arranged such that they engage with one another for the bendings beyond the upper end of the threshold angle range in order to create the additional tensile stress. In the embodiments of a bending system 205 shown in FIGS. 2*a-e*, the way in which this happens is that the first bending elements 210 comprises at least one protrusion 215 that is arranged within a recess 226 of the second bending element 220 and which at least partially abuts in a force-fit manner on an edge of the recess 226 for the bendings beyond the upper end of the threshold angle range. This situation, in which the two bending elements "lock up", is best seen in FIGS. 2*c* and 2*e*.

In some embodiments, the second bending element 220 also comprises at least one such protrusion 225 that is arranged in a recess 216 of the first bending element 210 and that at least partially abuts in a force-fit manner on an edge of the recess 216 in the first bending element 210 for the bendings beyond the upper end of the threshold angle range. In certain embodiments of the bending system 205 shown in FIGS. 2*a-e*, the protrusion 215 directly transitions into the recess 216, and the recess 226 directly transitions into the protrusion 225: by the chosen arrangement, the first 210 and the second 220 bending element "interlock" particularly strongly and hence a particularly good transfer of forces between the two bending elements 210 and 220 for bendings beyond the upper end of the threshold angle range is possible, see FIGS. 2*c* and 2*e*.

On the other hand, the bending system 205 comprises a first securing device 211, 221 and a second securing device 212, 222, wherein the first securing device 211, 221 is arranged such that it prevents a movement of the bending system 205 relative to the first securing device 211, 221, and the second securing device 212, 222 is arranged such that it allows a movement of the bending system 205 relative to the second securing device 212, 222 for a bending up to the upper end of the threshold angle range and prevents the movement for the bendings beyond the upper end of the threshold angle range, which in turns creates a tensile stress in the bending system 205.

As indicated in FIGS. 2*b-e*, it is possible that the second securing device 212, 222 is arranged in an opening 218, 228 in the bending system 205 such that it can move substantially freely—i.e. up to small friction forces which are unavoidable due to the construction—within the opening 218, 228 for a bending up to the upper end of the threshold angle range, and that a further movement is prevented by an edge of the opening 218, 228 for bendings beyond the upper end of the threshold angle range. This situation, in which a further movement is prevented and thus the tensile stress is created within the bending system 205, is particularly clearly depicted in FIGS. 2*c* and 2*e*. A particularly simple construction results if the openings 218, 228 are provided as an elongated hole, as indicated here. However, in some embodiments, oval openings or straight or curved grooves or something similar may be used. As a first securing device 211, 221 and/or second securing device 212, 222, one or more screws and/or rivets may be considered, which may for example be made of plastics and/or metal. However, in certain embodiments, different securing devices are for example made from plastics.

In the embodiments of a supporting element 200 with a bending system 205 shown in FIGS. 2*a-e*, the first bending element 210 is arranged in the lateral mid- to forefoot region and the second bending element 220 in the medial mid- to forefoot region.

The first securing device 211 comprises a double rivet at the side of the first bending element 210 that faces the midfoot. The second securing device 212 comprises a rivet in the middle of the first bending element 210 as well as a double rivet at the side of the first bending element 210 that faces the tip of the foot.

The first securing device 221 comprises a double rivet at the side of the second bending element 220 that faces the tip of the foot. The second securing device 222 comprises a rivet in the middle of the second bending element 220 as well as a double rivet at the side of the second bending element 220 that faces the midfoot.

Reference is made to the fact that for example the single rivets in the middle of the two bending elements 210 and 220 may also be omitted or multiple rivets may be arranged at this position, and that instead of the shown double rivets, only one rivet or more than two rivets may be arranged at the respective positions. In general, the skilled person will realize that there is the possibility that the first securing devices 211, 221 and/or the second securing devices 212, 222 may be varied in their arrangement and number such that the desired properties of the bending system 205 and the supporting element 200 may be achieved.

Figure 9:
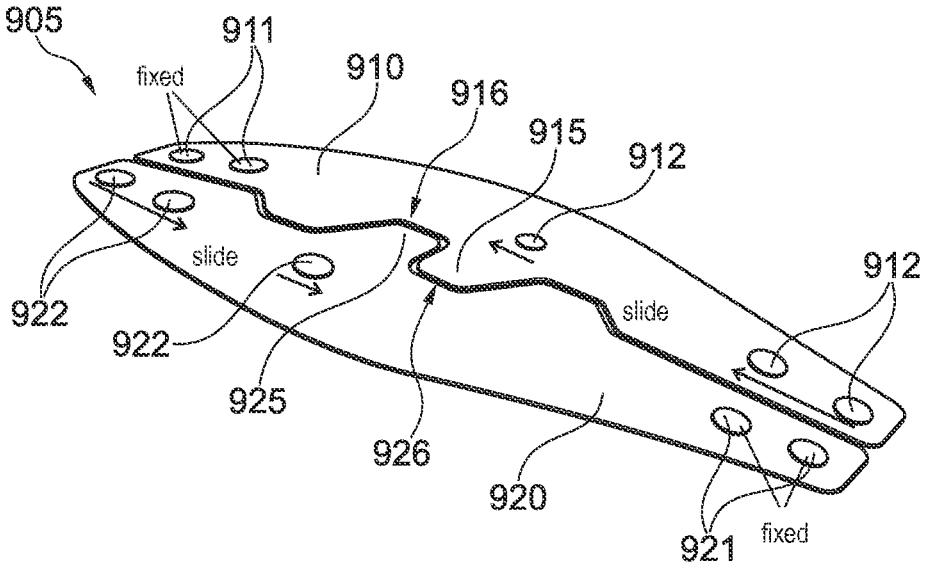
FIGS. 9-11 are views of a supporting element with a bending system, according to certain embodiments of the present invention.

A possible variation is for example shown in FIG. 9. The embodiments of a bending system 905 shown there are similar to the embodiments of the bending system 205. In this respect, reference is made to the explanations regarding the bending system 205. The bending system 905 in particular comprises a first bending element 910 and a second bending element 920, which each comprise protrusions 915, 925 and corresponding recesses 916, 926.

The bending system 905 differs mainly in the arrangement of the first 911, 921 and second 912, 922 securing devices. In contrast to the embodiments of a bending system 205 shown in FIGS. 2*a-e*, the first securing device 911 comprises a double rivet at the side of the first bending element 910 facing the tip of the foot. The second securing device 912 comprises a rivet in the middle of the first bending element 910 as well as a double rivet at the side of the first bending element 910 facing the midfoot.

The first securing device 921 comprises double rivet at the side of the second bending element 920 facing the midfoot. The second securing device 922 comprises a rivet in the middle of the second bending element 920 as well as a double rivet at the side of the second bending element 920 facing the tip of the foot.

At this point, it shall further be particularly emphasized that the mechanism explained above with a first and second securing device is individually valid for each bending element 210 and 220 or 910 and 920, respectively. In some embodiments, a bending system (not shown) based on this principle only comprises, for example, a first bending element 210 with a first securing device 211 and a second securing device 212 as described above.

The bending system can for example comprise a single bending element, for example in the form of a metal- or plastic sheet. The bending system can further comprise a first securing device with which the bending element is fixedly connected with a sole, for example riveted or screwed. The bending system can comprise a second securing device, for example a rivet or screw arranged within an elongated hole or some other opening in the bending element. The second securing device allows the bending system to move substantially freely—i.e. up to small friction forces that are unavoidable due to the construction—within the elongated hole or the opening for a bending up to the upper end of the threshold angle range. For bendings beyond the upper end of the threshold angle range, a further movement of the bending system is prevented by an edge of the elongated hole or the opening. The first securing device may be arranged in the forefoot region of the sole and the second securing device in the midfoot region, or vice versa.

Here, it is explicitly mentioned again that it is possible for embodiments of the supporting element with a bending system to only employ one of the two mechanisms for increasing the tensile stress described above. In this regard, reference is made to FIGS. 10 and 11, showing sections of embodiments of bending systems 1005, 1105, similar to FIGS. 2*d* and 2*e*.

Figure 10:
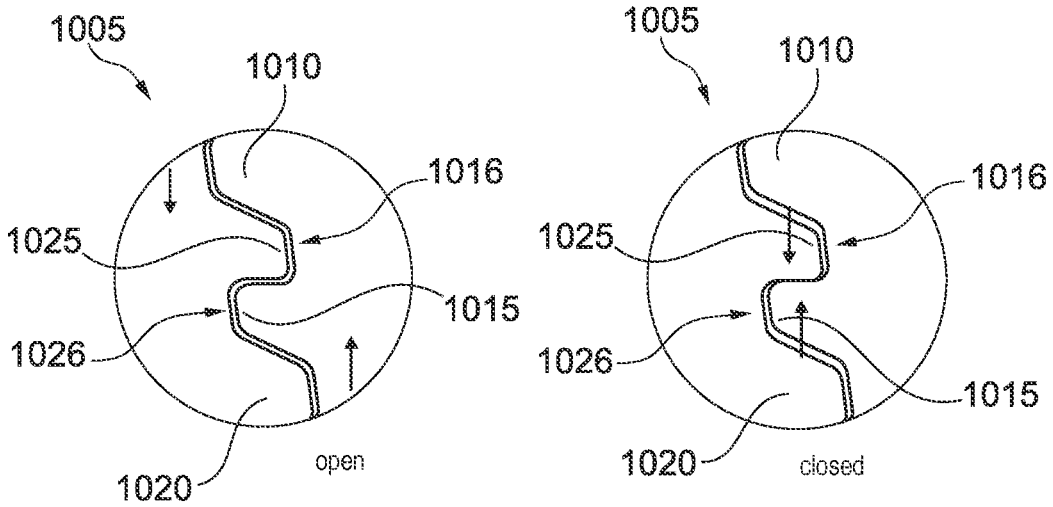

The embodiments of a bending system 1005 shown in FIG. 10 comprise a first bending element 1010 and a second bending element 1020, wherein each comprise at least one protrusion 1015, 1025, which lock up (s. right half of FIG. 10) with at least one corresponding recess 1016, 1026, respectively, for bendings beyond the upper end of the threshold angle range in order to create the additional tensile stress and therefore the increased bending stiffness in the bending system 1005. The first and second bending element 1010, 1020 are for example fixedly connected with a sole, sole plate or something similar at an appropriate position (not shown). For more details on this, reference is made to the other embodiments described herein, in particular the explanations with regard to the supporting element 200.

Figure 11:
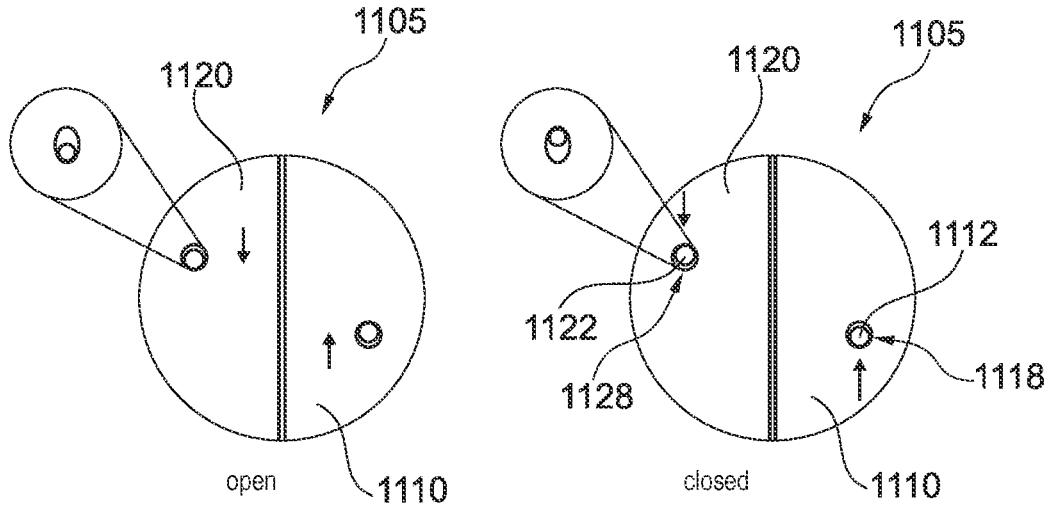

The embodiments of a bending system 1105 shown in FIG. 11 also comprise a first bending element 1110 and a second bending element 1120. The first bending element 1110 and the second bending element 1120 are for example also fixedly connected with a sole, sole plate or something similar via a corresponding first securing device (not shown), see the discussion with respect to FIG. 10. Here, however, the first bending element 1110 and the second bending element 1120 each comprise at least one second securing device 1112, 1122, arranged in a corresponding elongated hole 1118, 1128 in the first or second bending element 1110, 1120, respectively, in such a manner that they allow the bending system 1105 to move substantially freely—i.e. up to small friction forces which are unavoidable due to the construction—within the elongated hole for a bending up to the upper end of the threshold angle range. For bendings beyond the upper end of the threshold angle range, a further movement of the bending system 1105 is prevented by an edge of the elongated hole.

It is clear to the person skilled in the art that the described mechanisms for increasing the tensile stress may be combined and varied in a suitable manner in order to provide a supporting element with the desired properties.

For providing the supporting element, the bending systems 905, 1005 or 1105 may for example be substituted for the bending systems 205 or 405 in the supporting elements 200 or 400 (regarding the supporting element 400, see below).

It shall furthermore be pointed out here that FIGS. 2*b-e*, 9, 10 and 11 mainly serve the purpose of illustrating the two above-mentioned mechanisms and that they do not necessarily show the actual proportions in every detail.

It shall also be mentioned again that the bending systems 205, 905, 1005 and 1105 described here are not coupled to the use of an insole plate 250. For example, the first securing devices 211, 221 may also be replaced by the first bending element 210 and/or the second bending element 220 being firmly bonded at the respective position with, for example, a midsole and/or an outsole, or being embedded in their material. The same applies, as already mentioned, for the embodiments of bending systems 905, 1005 and 1105.

In the embodiments of a supporting element 200 with the bending system 205 (or bending systems 905, 1005, 1105) describe here, the position of the threshold angle range depends primarily on how much "clearance" there is in the neutral, force-free state (i.e. how large the distance is):

a) between the engaging protrusions 215, 225 and recesses 216, 226 of the first bending element 210 and the second bending element 220, as well as b) between the second securing devices 212, 222 and those edges of the corresponding openings 218, 228 in the bending system 205 which prevent the further movement of the bending system for bendings beyond the upper end of the threshold angle range.

This clearance may for example be chosen such that the threshold angle range—measured relative to the initial unbent state, see the explanations with regard to FIG. 1*b*—is located at angles between 10° and 30°, may further be located at angled between 15° and 25°, and may yet further be located at angles between 18° and 22°. In order to achieve this, the above-mentioned clearance may for example be approximately 1 mm. The skilled person will understand that the necessary amount of clearance can in principle be derived from geometrical considerations, if in particular the length of the supporting element 200 and its later position in a sole or a shoe is known.

It is in particular possible that the distances mentioned above under a) and b) are chosen such that both mechanisms "lock up" in the same threshold angle range.

In some embodiments, the respective distances are chosen such that the two mechanisms lock up in different threshold angle ranges and therefore lead to a step-wise increase of the bending stiffness of the supporting element 200. For example, the distance mentioned under b) above may be chosen larger, for example twice as large, as the distance mentioned under a) (or vice versa, see below). Then, the protrusions 215, 225 and recesses 216, 226 will initially lock up for bendings beyond an upper end of a first threshold angle range, while a movement of the bending system 205 relative to the second securing devices 212, 222 is still possible, as they do not yet "abut" on the edge of the openings 218, 228. This creates a first additional tensile stress leading to a first increase of the bending stiffness. Under further bending beyond an upper end of a second threshold angle range, also the second securing devices 212, 222 lock up with the openings 218, 228 and hence create an additional second tensile stress in the bending system 205, which adds to the first additional tensile stress. This leads to a further increase of the bending stiffness, which hence increases in "two stages." This can increase the durability of the bending system 205.

With regard to the durability of the bending system 205, it is generally remarked that the securing devices 211, 212, 221 and 222 may also serve the purpose of preventing the bending elements 210, 220 from sliding on top of each other and potentially getting jammed.

In the embodiments described here, the threshold angle range discussed so far therefore corresponds to a first threshold angle range and a supporting element 200 is obtained that is provided such that it comprises a first bending stiffness for bendings from the initial unbent state to the upper end of the first threshold angle range and comprises a second bending stiffness for bendings beyond the upper end of the first threshold angle range, wherein the second bending stiffness is greater than the first bending stiffness. In these embodiments, the supporting element is further provided such that for bendings beyond an upper end of the second threshold angle range, it comprises a third bending stiffness, which is greater than the second bending stiffness, wherein the second threshold angle range, measured relative to the initial unbent state, extends across larger angles than the first threshold angle range.

In further embodiments, the proportions are reversed, i.e. the distance mentioned under a) between the engaging protrusions 215, 225 and recesses 216, 226 of the first bending element 210 and second bending element 220 is greater than the distance mentioned under b) between the second securing devices 212, 222 and the edges of the corresponding openings 218, 228 in the bending system 205. Here, the distance mentioned under a) may for example be approximately 1.2 mm and the distance mentioned under b) for example approximately 1 mm.

In these embodiments, then, the securing devices 212, 222 lock up with the edges of the openings 218, 228 before the protrusions 215, 225 lock up with the recesses 216, 226. This may provide that a sliding on top of each other and a potential jamming of the bending elements 210 and 220 is prevented particularly well. This, in turn, may further increase the durability of the bending system 205.

The ratio of the first bending stiffness to the second bending stiffness in particular depends on how large the additional tensile stress is which is created in the bending system 205 for bendings beyond the upper end of the threshold angle range. It depends, among other things, on the material of the bending system 205, its length, thickness, and so forth. Possible values for the ratio of the second to the first bending stiffness lie between 1.1:1 and 4:1, in particular between 1.2:1 and 3:1, and more particularly between 2:1 and 2.4:1. These values have turned out suitable to obtain the desired roll-off and supporting properties discussed in the beginning.

Figure 3A:
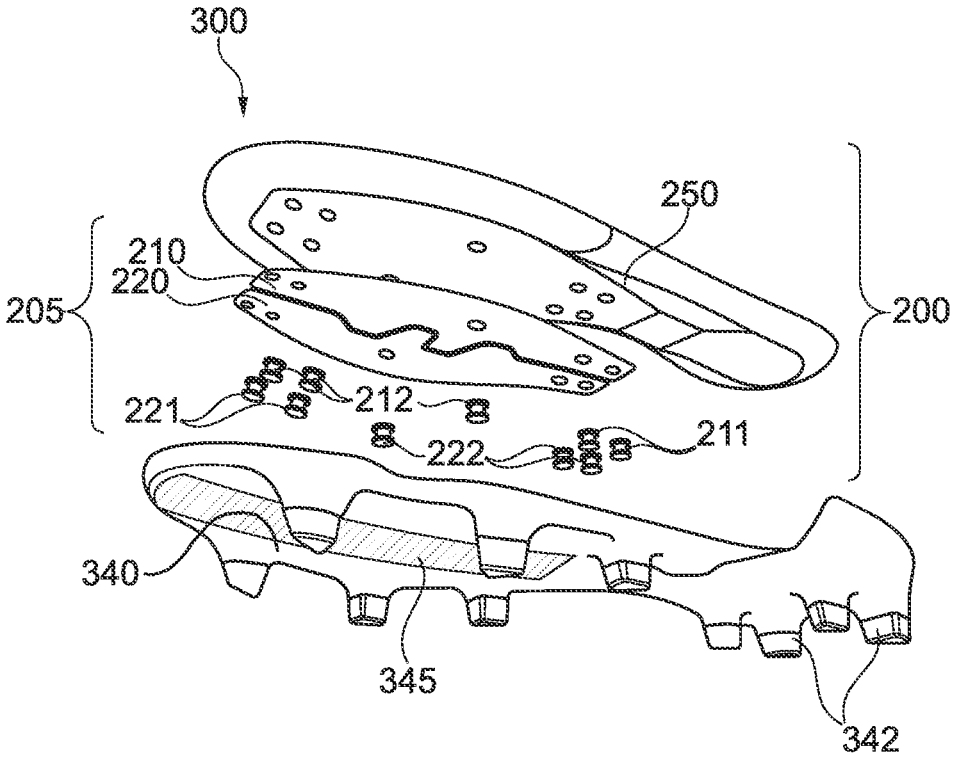
FIGS. 3*a-b* are views of a sole for a soccer shoe, according to certain embodiments of the present invention.
Figure 3B:
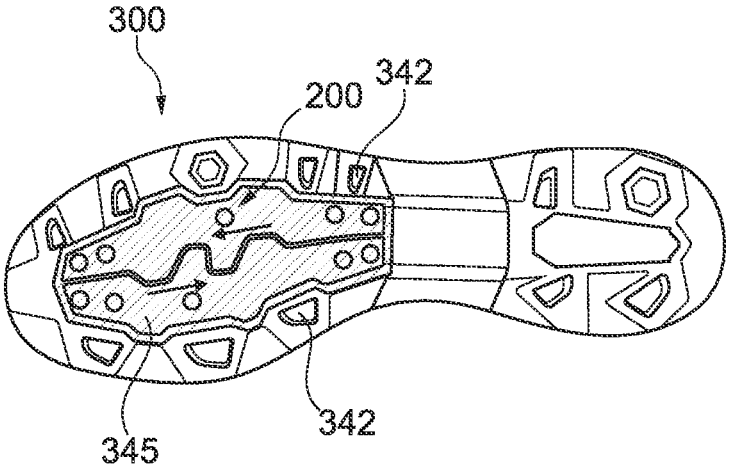

FIGS. 3*a-b* show further embodiments of a sole 300 for a soccer shoe. The sole 300 comprises a supporting element, which, in the case of FIGS. 3*a-b*, is the above-described supporting element 200 that comprises an insole plate 250 and a bending system 205. However, different embodiments of the supporting element may also be used here. The sole 300 further comprises an outsole 340. The outsole comprises a number of cleat elements 342. The cleat elements may potentially be provided as an integral piece with the remainder of the outsole 340. This leads to particular high stability of the outsole 340. Further, the outsole 340 potentially comprises a transparent window 345. This window allows to have a look at the "interior workings" of the sole and the mechanics of the supporting element 200 from the outside. The window need not, however, be necessarily transparent, rather it can also be semi-transparent and/or comprise a declaration foil, and so forth. In addition, the window is not a mandatory part of embodiments of soles. It is also possible that embodiments of a sole only comprises a cavity, for example, which provides room for the inner workings of the sole, in particular for embodiments of the supporting element or bending system.

FIGS. 4*a-d* show further embodiments of a supporting element 400. The explanations made with regard to the supporting element 200 also apply analogously to the supporting element 400 shown in FIGS. 4*a-d*. Differences between the supporting elements 200 and 400 first and foremost lie in the shape and arrangement of the first 210, 410 and second 220, 420 bending elements, in the shape of the protrusions 215, 225, 415, 425 and recesses 216, 226, 416, 426 as well as in the arrangement of the first 211, 221, 411, 421 and second 212, 222, 412, 422 securing devices.

Figure 4A:
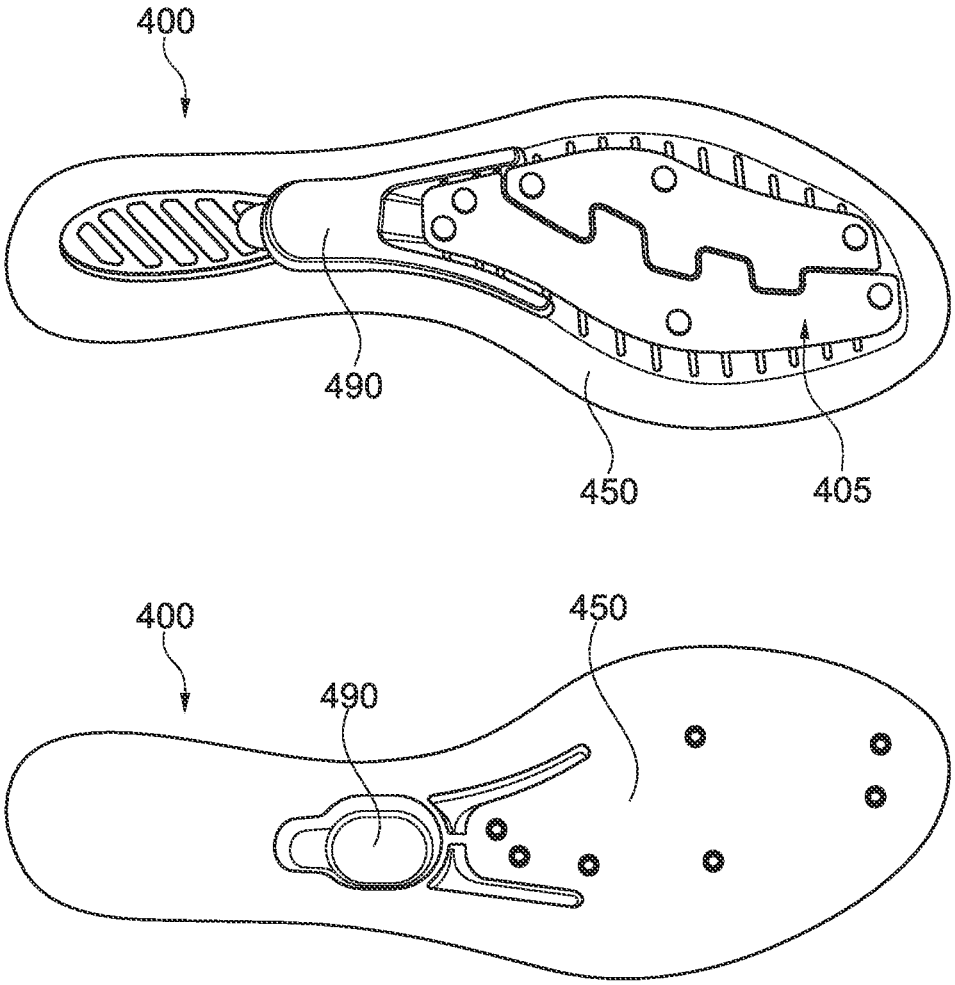
FIGS. 4*a-d* are views of a supporting element, according to certain embodiments of the present invention.
Figure 4B:
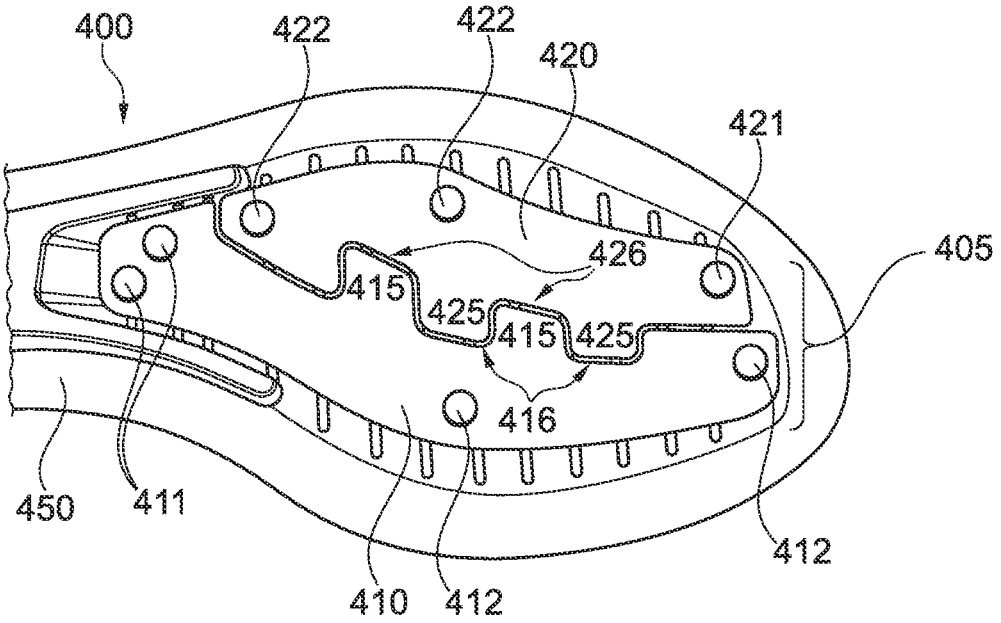
Figure 4C:
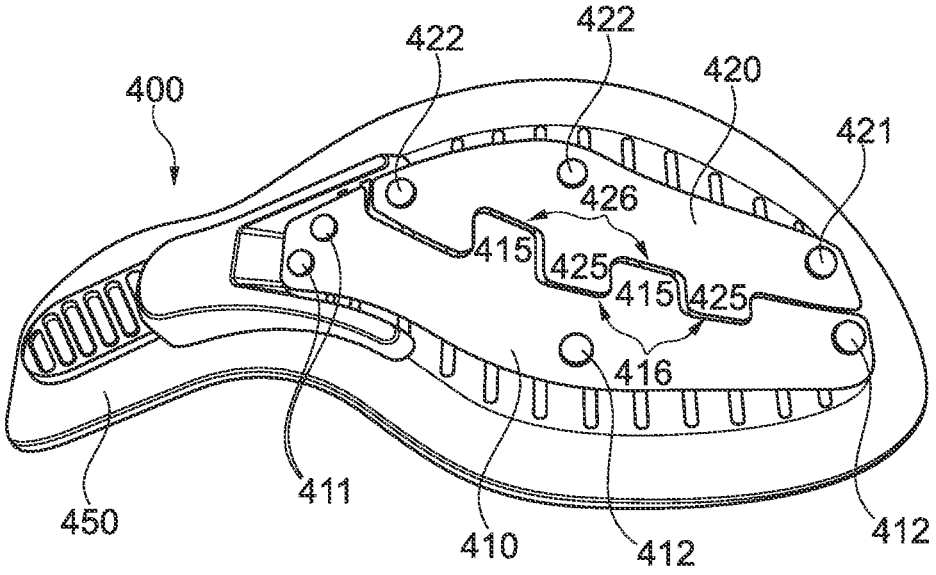
Figure 4D:
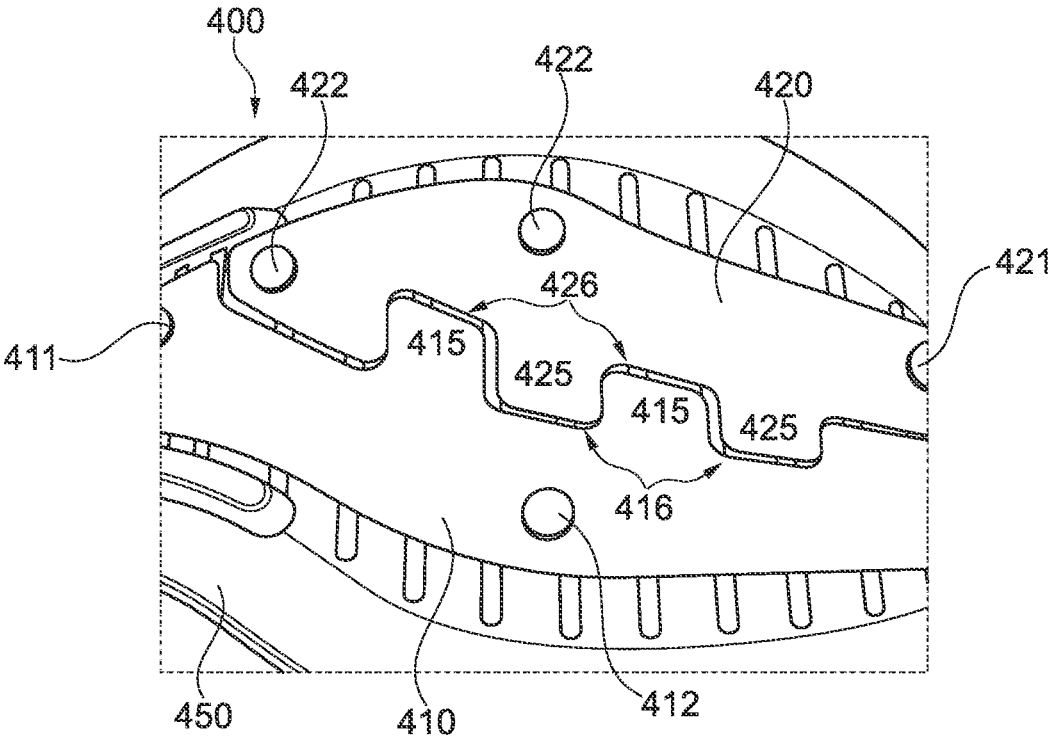

In FIGS. 4*a-b*, the supporting element 400 is shown in the neutral, force-free state, whereas FIGS. 4*c-d* show the supporting element 400 under a bending beyond the upper end of the threshold angle range.

FIG. 4*a* shows the supporting element 400 in its entirety. The supporting element 400 comprises an insole plate 450 and a bending system 405. The supporting element 400 is provided such that it supports in particular the front half of the foot in the above-described inventive manner. The insole plate 450 comprises a cavity 490 in the embodiments shown here. This cavity can for example serve the purpose of receiving an electronic component or something similar. It shall be mentioned here, however, that such a cavity 490 is merely an optional feature and is not a mandatory part of embodiments of supporting elements or soles.

FIG. 4*b* shows an enlarged view of the front half of the supporting element 400 including the bending system 405. The bending system 405 comprise a first bending element 410 and a second bending element 420. The two bending elements 410 and 420 are manufactured from spring steel plates, for example with a thickness from 0.3 mm to 0.7 mm, for example 0.5 mm, in the embodiments shown here. It is noted that the bending elements 410 and/or 420 may, however, also comprise different materials or be made from different materials, for example plastic materials. The first bending element 410 further comprises protrusions 415, which are each arranged in a recess 426 of the second bending element 420 and which at least partially abut in a force-fit manner on an edge of the respective recess 426 for the bendings beyond the upper end of the threshold angle range, as shown in FIGS. 4*c* and 4*d*. In a similar manner, the second bending element 420 comprises protrusions 425, which are arranged in recesses 416 of the first bending element 410 and which at least partially abut in a force-fit manner on an edge of the respective recess 416 for the bendings beyond the upper end of the threshold angle range. This leads to an additional tensile stress in the bending system 405 for the bendings beyond the upper end of the threshold angle range, which increases the bending stiffness of the bending system 405 and hence the supporting element 400 (see FIG. 4*e*).

In addition, each of the two bending elements 410 and 420 comprises at least one first securing device 411, 421 and one second securing device 412, 422. In the case of the supporting element 400 shown here, the first securing device 411, 421 and the second securing device 412, 422 are each comprised of one or several rivets. In each case, the first securing device 411, 421 is arranged such that it prevents a movement of the first/second bending element 410/420 relative to the first securing device 411/421. In the present case, the first/second bending element 410/420 is fixedly riveted to the insole plate 450 by the rivets 411/421. In the case shown here, the second securing device 412/422 is comprised of rivets which are fixedly connected with the insole plate 450 and which are, however, arranged in elongated holes in the first/second bending element 410/420 (which are not visible in FIGS. 4*a-d* since they are hidden by the heads of the rivets) in such a manner that they may move substantially freely within the elongated holes for bendings up to an upper end of the threshold angle range. For bendings beyond the upper end of the threshold angle range, on the other hand, an edge of the elongated holes prevents a further movement and hence creates an additional tensile stress in the bending elements 410 and 420 and therefore in the bending system 405.

Figure 4E:
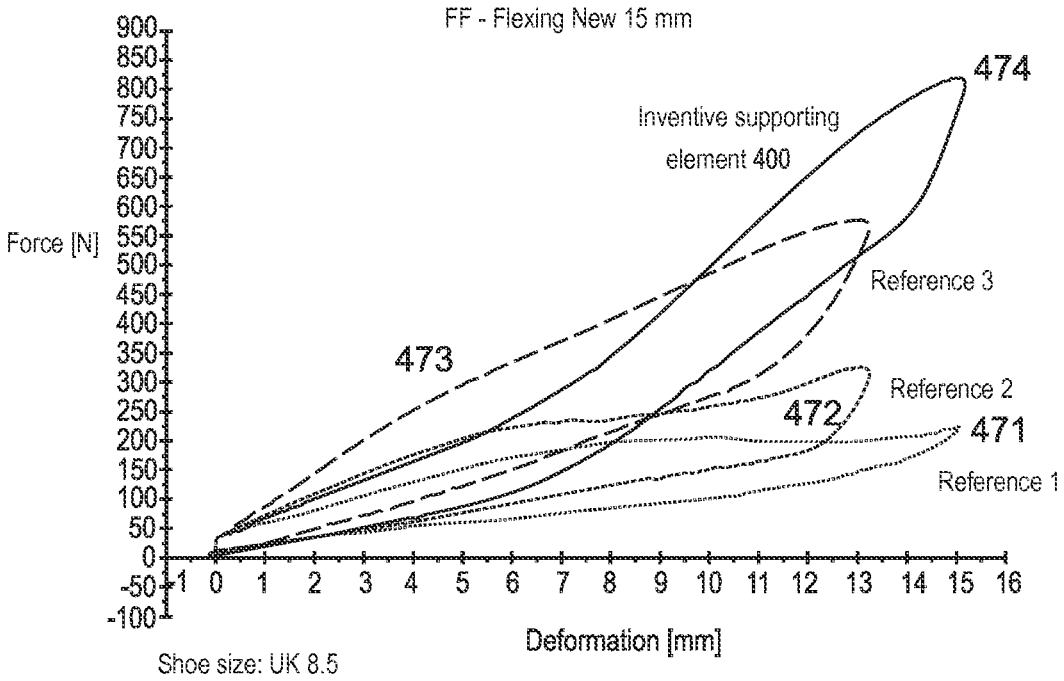
FIGS. 4*e-f* are illustrations of measurement results of the bending stiffness of the supporting element of FIGS. 4*a-d*.

The clearance, i.e. the distance between the protrusions 415, 425 and the respective edge of the corresponding recesses 416, 426, amounts to approximately 1.2 mm in the embodiments shown here. The clearance of the rivets 412 and 422 in the elongated holes is chosen approximately the same size. The clearance of the rivets 412, 422 in the elongated holes is for example approximately 1 mm. As shown in FIG. 4*e*, this has the effect that the threshold angle range—measured relative to the initial unbent state, see the explanations with regard to FIG. 1*b*—lies in the range around displacements of approximately 7 mm in the present embodiments, which corresponds to a bending angle of approximately 20° for the supporting element 400 of shoe size UK 8.5 (or US men's shoe size 9).

Figure 4F:
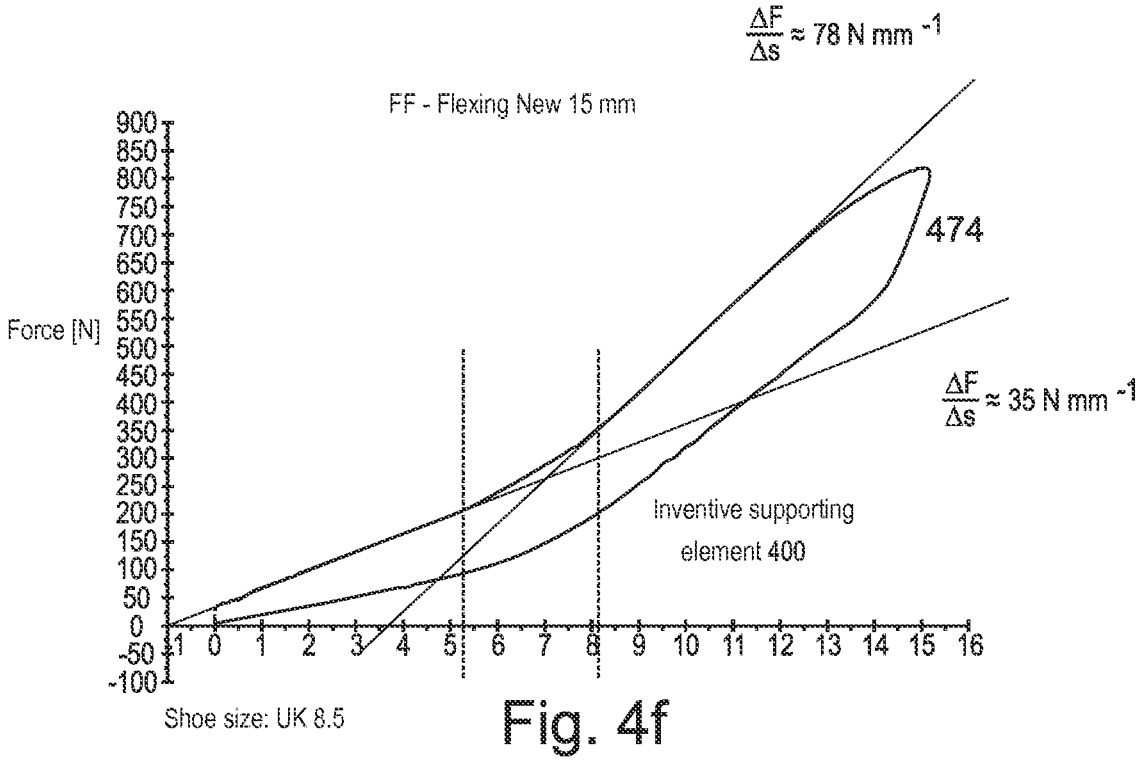

Finally, FIGS. 4*e-f* show different displacement-force-curves 471, 472, 473, 474, which were measured with a measuring method like the method described in FIGS. 1*a-c*. The measurement curves 471, 472 and 473 show displacement-force-curves for supporting elements from the prior art, whereas the displacement-force-curve 474 corresponds to the supporting element 400. Supporting elements for soles of shoes with shoe size UK 8.5 where used in the measurements.

The most striking feature of the measurements is that for all supporting elements from the prior art, i.e. measurement curves 471, 472, 473, the first bending stiffness for bendings up to the upper end of the threshold angle range is smaller than for bendings beyond the upper end of the threshold angle range. For all measurements, the threshold angle range lies in the range between approximately 5 mm to 9 mm. That means that the supporting elements known from the prior art become softer starting from the neutral, force-free initial unbent state.

Only the supporting element 400, measurement curve 474, shows the desired behavior, namely starting from the force-free initial unbent state an increase in the bending stiffness for bendings beyond the upper end of the threshold angle range. This means that the supporting element 400 becomes harder for bendings beyond the upper end of the threshold angle range.

As indicated in FIG. 4*f*, the first bending stiffness of the supporting element 400 is approximately constant for bendings up to the upper end of the threshold angle range. The same is true for the second bending stiffness for bendings beyond the upper end of the threshold angle range (at least up to a saturation value for high bending angles).

It is to be noted, however, that such a constant bending stiffness for bendings up to the upper end of the threshold angle range and/or for bendings beyond the upper end of the threshold angle range is not a mandatory feature of the present invention. Rather, the exact shape of the displacement-force-curve of embodiments of the supporting element depends on the chosen specific design in a given case. As already mentioned numerous times, it is important that the supporting element comprises a first bending stiffness for bendings up to the upper end of the threshold angle range and a second bending stiffness for bendings beyond the upper end of the threshold angle range, wherein the second bending stiffness is greater than the first bending stiffness.

As indicated in FIG. 4*f*, for the regions of approximately constant bending stiffness, the ratio of the second bending stiffness to the first bending stiffness is approximately 78 N $mm^{-1}$/35 N $mm^{-1}$≈2.23.

It is further to be noted that for all supporting elements on which measurements were taken, not the entire amount of energy exerted for bending the supporting elements was released again upon return to the initial unbent state. Therefore, the measurement curves 471, 472, 473 and 474 show the characteristic shape of hysteresis-curves.

FIGS. 5, 6*a-c*, 7 and 8 show further possible embodiments of supporting elements, as well as embodiments of shoe soles and shoes with such supporting elements. In order to avoid unnecessary repetitions, the explanations put forth in the context of the embodiments already discussed in general also apply—if applicable—to all embodiments discussed in the following. This is in particular true for the location of the threshold angle range, the ratio of the first and the second bending stiffness, materials used, and so forth.

Figure 5:
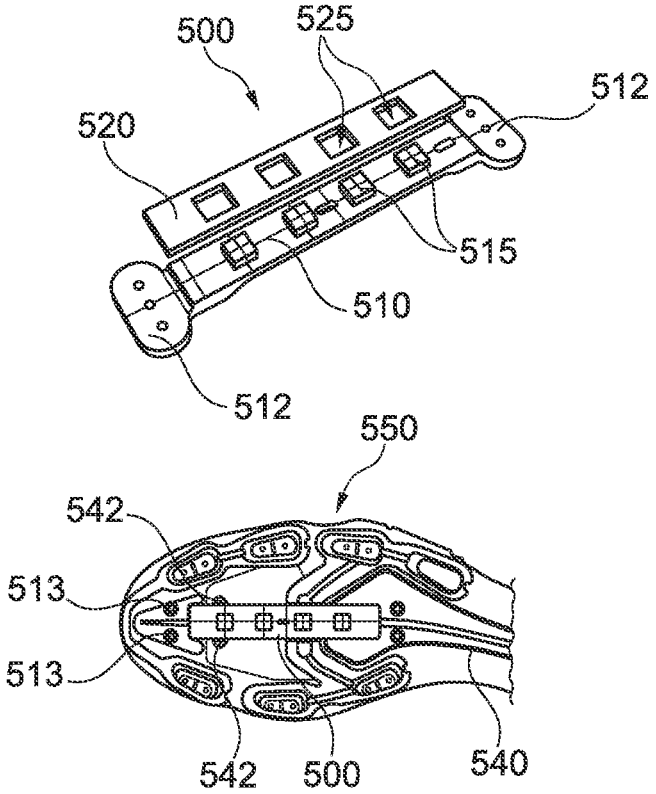
FIG. 5 includes views of a supporting element and a soccer shoe with such a supporting element, according to certain embodiments of the present invention.

FIG. 5 shows further embodiments of a supporting element 500. The supporting element 500 comprises a bending system 500 which is provided such that for the bendings beyond an upper end of the threshold angle range, an additional tensile stress is created in the bending system 500 and in this way the bending stiffness is increased. For the bending system 500 this is achieved by the bending system 500 comprising a first bending element 510 and a second bending element 520 which are arranged in such a manner that they engage with each other for the bendings beyond the upper end of the threshold angle range in order to create the additional tensile stress. More precisely, in the present case the first bending element 510 comprises at least one protrusion 515 which is arranged in a recess 525 of the second bending element 520 and which abuts in a force-fit manner on an edge of the recess 525 for the bendings beyond the upper end of the threshold angle range.

The bending system 500 shown in FIG. 5 comprises four such protrusions 515 and four corresponding recesses 525, wherein the protrusions 515 are provided with a quadratic cross-section and the recesses 525 with a rectangular cross-section. However, in some embodiments, a different number of protrusions 515 and/or recesses 525 may be used. Also, a different cross-sectional shape may be chosen. The protrusions 515 could for example be provided with a circular cross-section and the recesses 525 correspondingly as an elongated holes. In some embodiments, the protrusions 515 are provided as pins, for example with a circular or oval cross-section. This may for example serve the purpose of simplifying the manufacture compared to the bending system 500 shown in FIG. 5. On the other hand, for the bending system 500 shown in FIG. 5, the transfer of forces between the protrusions 515 and the edges of the recesses 525 for bendings beyond the upper end of the threshold angle range may potentially be better.

The first bending element 510 and/or the second bending element 520 may be provided as flexible metal plates. In some embodiments, the first bending element 510 and/or the second bending element 520 comprise at least one of the following materials: plastics, for example polyoxymethylene and/or polyamide, glass fibers.

A shoe 550 is further shown in FIG. 5, which comprises a sole 540 with a supporting element 500. The supporting element 500 is arranged such that it supports the foot in the region of the front half of the foot, in particular in the region of the MTP joints. Herein, the first bending element 510 is for example connected with a midsole layer (not shown) of the sole 540, for example by screws 513 and/or rivets (not shown) at the two ends 512 of the first bending element 510 provided for this purpose, whereas the end of the second bending element 520 facing the tip of the foot (the front end) is connected to an outsole layer of the sole 540. To this end, the front end of the second bending element 520 may for example be embedded in the material of the outsole and/or be fixated to the outsole by additional fixation devices 542. These fixation devices 542 may for example be manufactured as a single integral piece with the outsole in such a manner that the second bending element 520 snaps into the fixation devices 542 under pressure and is hence fixated, as shown in FIG. 5. Under a bending of the sole 540 in the forefoot region up to the upper end of the threshold angle range, the second bending element 520 connected to the outsole in this manner will slide relative to the first bending element 510 fixedly connected with the midsole. For bendings beyond the upper end of the threshold angle range, however, a further sliding is prevented by the engaging protrusions 515 and recesses 525 and an additional tensile stress is created within the sole 540.

Figure 6A:
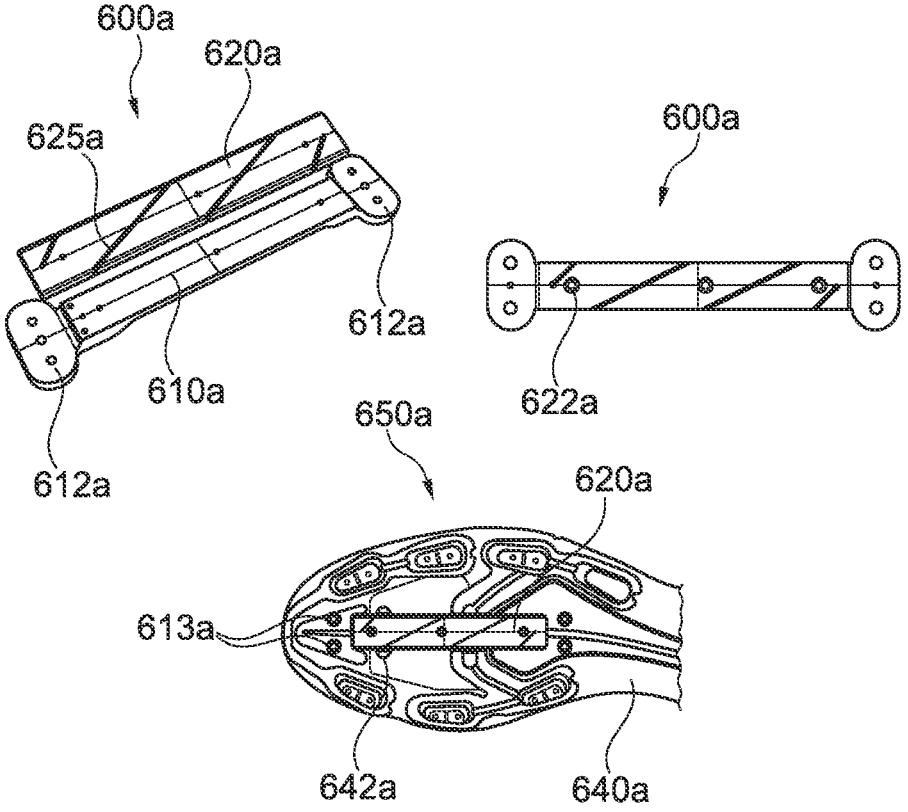
FIGS. 6*a-c* are views of supporting elements, each comprising a rope element, as well as embodiments of soccer shoes, each having such a supporting element, according to certain embodiments of the present invention.
Figure 6B:
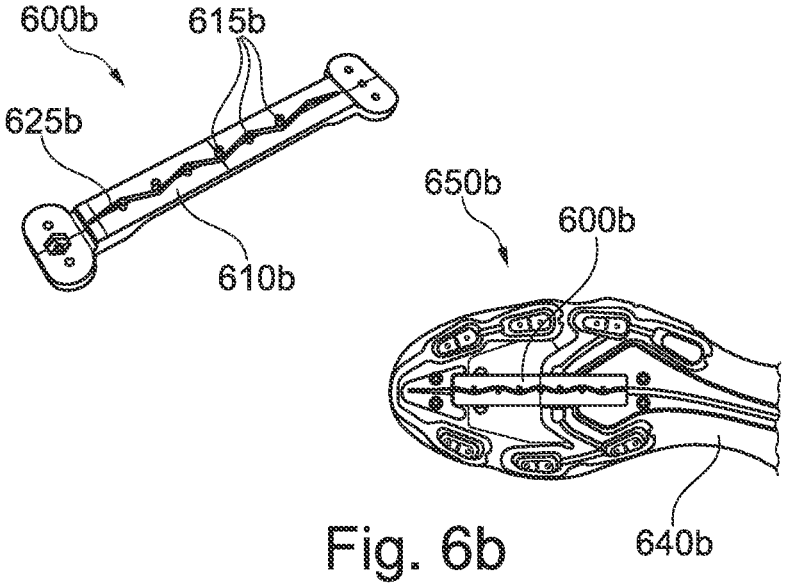
Figure 6C:
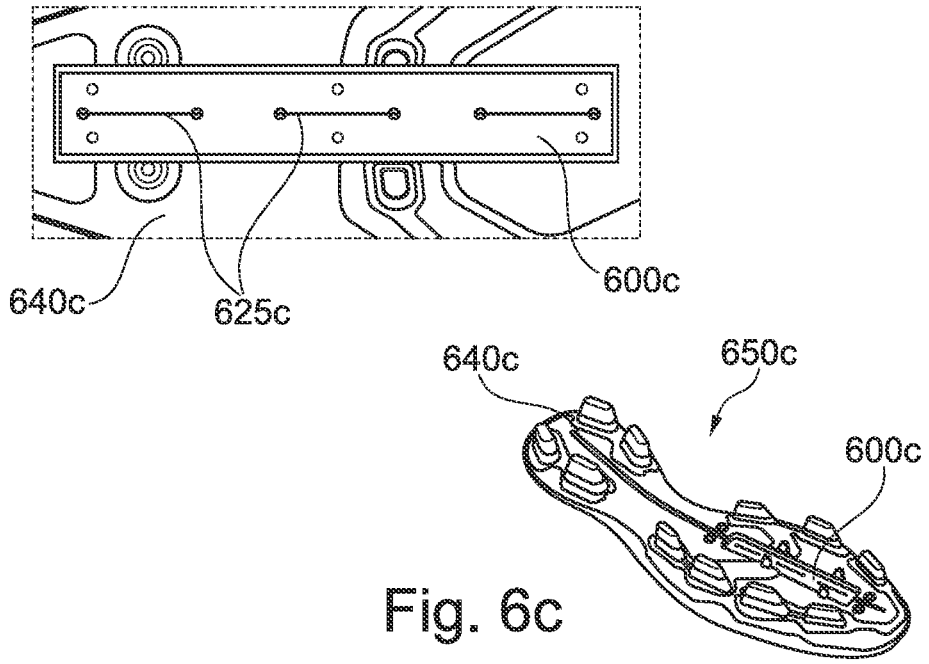

FIGS. 6*a-c* show further embodiments of supporting element 600*a*, 600*b* and 600*c*. The supporting elements 600*a*, 600*b*, 600*c* each comprise a bending system 600*a*, 600*b*, 600*c* that is provided in such a manner that for the bendings beyond an upper end of a threshold angle range an additional tensile stress is created in the bending system 600*a*, 600*b*, 600*c* and thus the bending stiffness is increased. To achieve this, the bending systems 600*a*, 600*b*, 600*c* each comprises a rope element 625*a*, 625*b*, 625*c*, wherein for bendings up to an upper end of the threshold angle range the rope element 625*a*, 625*b*, 625*c* is subject to a first tensile stress and for bendings beyond the upper end of the threshold angle range is subject to a second tensile stress, which is greater than the first tensile stress. In some embodiments, the first tensile stress is equal to zero, i.e. for bendings up to the upper end of the threshold angle range there is a certain degree of "slack rope" in the rope element 625*a*, 625*b*, 625*c*. In some embodiments, for bendings up to the upper end of the threshold angle range, there is already a first tensile stress in the rope element 625*a*, 625*b*, 625*c*. The rope element 625*a*, 625*b*, 625*c* can for example comprise two kinds of fiber elements (not shown), of which the first kind is already subject to a tensile stress for bendings up to the upper end of the threshold angle range, while the second kind is initially substantially free of tension and only become subject to a tensile stress for bendings beyond the upper end of the threshold angle range.

The supporting element 600*a* shown in FIG. 6*a* comprises a first bending element 610*a*, as well as a second bending element 620*a*. The rope element 625*a* is further connected to two opposing ends of the second bending element 620*a* and diagonally wound around it in such a manner that for bendings up to the upper end of the threshold angle range, there is a certain degree of "slack rope" in the rope element 625*a*, while for bendings beyond the upper end of the threshold angle range, the rope element 625*a* is stretched and hence an additional tensile stress is created within the rope element 625*a*. The first bending element 610*a* may for example be fixedly arranged at the second bending element 620*a*, for example by screws 622*a*, as shown in FIG. 6*a*, and/or by rivets.

In some embodiments, the first bending element 610*a* and the second bending element 620*a* are connected to each other in such a manner that for bendings up to the upper end of the threshold angle range, they may initially move with respect to each other and only for bendings beyond the upper end of the threshold angle range lock up, as already described herein. To achieve this, the screws 622*a* may for example be arranged within elongated holes of the second bending element 620*a*. The creation of the additional tensile stress in the rope element 625*a* may then set in the same threshold angle range in which the screws 622*a* lock up with the second bending element 620*a*, or in a different threshold angle range, for example at larger bending angles.

FIG. 6*a* further shows a shoe 650*a* with a sole 640*a* with a supporting element 600*a* which is connected with the sole 640*a* by screws 613*a* and/or rivets (not shown) at the ends

612*a* provided for this. In addition, additional fixation devices 642*a* can further fixate the supporting element 600*a* at the sole 640*a*.

The supporting element 600*b* shown in FIG. 6*b* only comprises one bending element 610*b*. The bending element 610*b* comprises a rope element 625*b*, which is guided in a zig-zag manner around a plurality of protrusions 615*b*. With regard to the rope element 625*b*, the shoe 650*b* and the arrangement of the supporting element 600*b* at the sole 640*b* of the shoe 650*b*, the above statements apply.

Finally, the supporting element 600*c* shown in FIG. 6*c* differs from the supporting element 600*b* shown in FIG. 6*b* only by the arrangement of the rope element 625*c*, which in the case of the supporting element 600*c* shown in FIG. 6*c* partially extends along a top side and partially along a bottom side of the supporting element 600*c*. With regard to the shoe 650*c* with a sole 640*c* with a supporting element 600*c* shown here, there are no significant differences to the shoes 650*a* or 650*b*, too.

Figure 7:
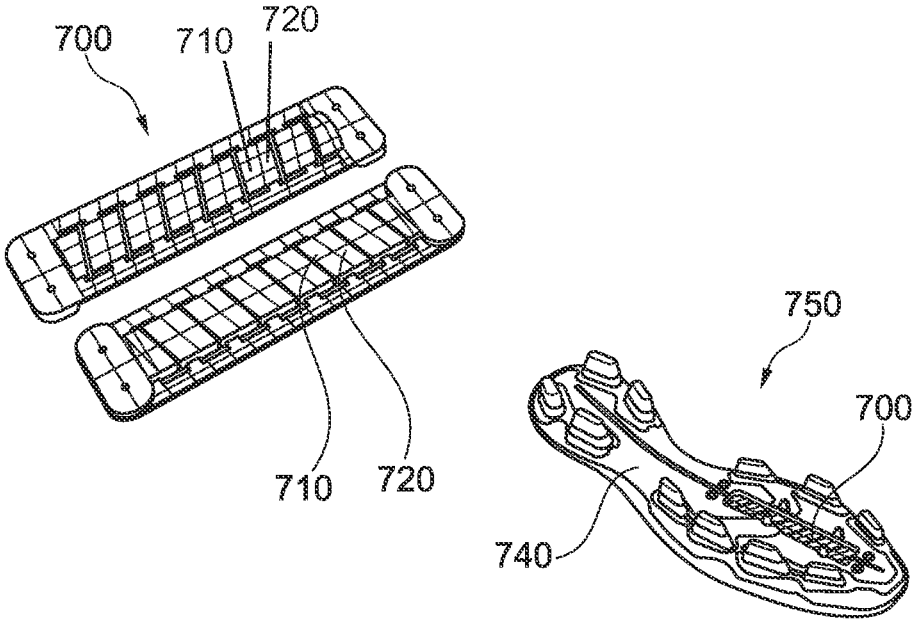
FIG. 7 includes views of a supporting element, which comprises a plurality of pressure elements, and of a soccer shoe with such a supporting element, according to certain embodiments of the present invention.

FIG. 7 shows further embodiments of a supporting element 700, as well as a shoe 750 with a sole 740 with such a supporting element 700. The supporting element 700 is provided such that it comprises a first bending stiffness for bendings from an initial unbent state up to an upper end of a threshold angle range and a second bending stiffness for bendings beyond the upper end of the threshold angle range, which is greater than the first, too. With regard to the position of the threshold angle range, the ratio of the first and the second bending stiffness, and so forth, reference is again explicitly made to the explanations further above which also apply to the supporting element 700.

The supporting element 700 comprises a bending system 700. The bending system 700 is now, however, provided in such a manner that for the bendings beyond the upper end of the threshold angle range, an additional compressive stress is created in the bending system 700 and the bending stiffness is thus increased. In the case shown here, the bending system 700 comprises a first pressure element 710 and a second pressure element 720. They are arranged in such a manner that for the bendings beyond the upper end of the threshold angle range, the first pressure element 710 and the second pressure element 720 are pressed onto each other in order to create an additional compressive stress that counteracts a further bending and therefore increases the bending stiffness of the bending system 700. The first pressure element 710 and the second pressure element 720 are for example provided such that for a bending up to the upper end of the threshold angle range, no additional compressive stress is created between the pressure elements 710 and 720.

To achieve this, a suitable clearance may for example be present between the first pressure element 710 and the second pressure element 720 in the force-free initial unbent state. The skilled person will further realize that by a suitable choice of the material of the first and/or second pressure element 710, 720, the additionally created compressive stress and hence the increase in the bending stiffness may be influenced. For example, the use of rubber for the pressure elements 710, 720 would lead to rather small additional compressive stresses and a rather small increase in the bending stiffness for bendings beyond the upper end of the threshold angle range, compared to, for example, the use of spring steel.

With regard to the fixation of the supporting element 700 at the sole 740 of the shoe 750, the statements made in the context of FIGS. 6*a-c* generally apply. However, it is to be noted that due to the modified principle for increasing the bending stiffness, namely the creation of an additional compressive stress instead of an additional tensile stress, the pressure elements 710, 720 may be arranged on the side of the shoe sole 740 facing towards the interior of the shoe.

In some embodiments, a supporting element may be manufactured as a single integral piece wherein recesses with a conical shape, which may be arranged on the side of the sole facing towards the interior of the shoe, extend between the first and second pressure elements. For bendings beyond the upper end of the threshold angle range, the conical recesses may disappear due to the bending of the supporting element such that the first and second pressure elements are pressed onto each other in order to create the additional compressive stress. The skilled person will realize that the design of the conical recesses, in particular their angle, influences the threshold angle range.

Figure 8:
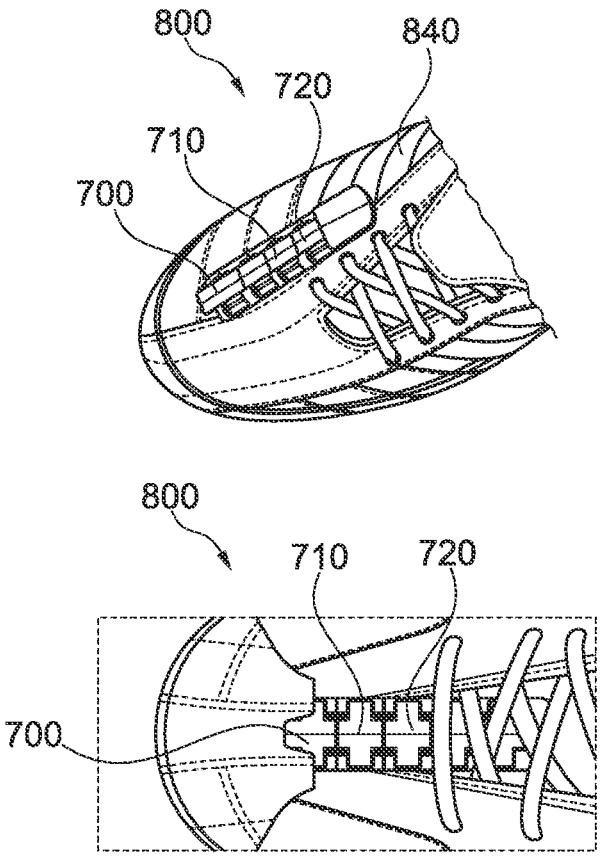
FIG. 8 includes views of a soccer shoe comprising a supporting element on the shoe upper, according to certain embodiments of the present invention.

FIG. 8 shows a further example 800 of the shoe 750 shown in FIG. 7. In contrast to the shoe 750, in the example 800 shown in FIG. 8, a supporting element, for example the supporting element 700, is arranged on a shoe upper 840. In this context it is to be noted that due to the modified position with regard to a curvature of the (fore-)foot, the pressure elements 710, 720 will potentially be arranged on the side of the shoe upper 840 facing away from the interior of the shoe in this case. Apart from that, the same considerations put forth with regard to the embodiments 700 and 750 shown in FIG. 7 apply.

In the following, further examples are described to facilitate the understanding of the invention:

1. Supporting element (200; 400; 500; 600*a*; 600*b*; 600*c*; 700) for a shoe (550; 650*a*; 650*b*; 650*c*; 750; 800), in particular a soccer shoe or American football shoe, wherein the supporting element (200; 400; 500; 600*a*; 600*b*; 600*c*; 700) is provided such that it
   a. comprises a first bending stiffness for bendings from an initial unbent state up to an upper end of a threshold angle range; and
   b. comprises a second bending stiffness for bendings beyond the upper end of the threshold angle range, wherein
   c. the second bending stiffness is greater than the first bending stiffness.
2. Supporting element (200; 400; 500; 600*a*; 600*b*; 600*c*; 700) according to example 1, wherein the threshold angle may range from 10° to 30°, may further range from 15° to 25°, and may even further range from 18° to 22°, measured relative to the initial unbent state.
3. Supporting element (200; 400; 500; 600*a*; 600*b*; 600*c*; 700) according to any one of the preceding examples, wherein the ratio of the second bending stiffness to the first bending stiffness lies in the range from 1.1:1 to 4:1, may further lie in the range from 1.2:1 to 3:1 and may even further lie in the range from 2:1 to 2.4:1.
4. Supporting element (200; 400; 500; 600*a*; 600*b*; 600*c*; 700) according to any one of the preceding examples, wherein the first bending stiffness and the second bending stiffness each correlates to a bending stiffness of the supporting element along a roll-off direction of the foot.
5. Supporting element (200; 400; 500; 600*a*; 600*b*; 600*c*; 700) according to any one of the preceding examples, wherein the supporting element is provided to support the front half of the foot.
6. Supporting element (200; 400; 500; 600*a*; 600*b*; 600*c*) according to any one of the preceding examples, wherein the supporting element (200; 400; 500; 600*a*; 600*b*; 600*c*) comprises a bending system (205; 405;

500; 600*a*; 600*b*; 600*c*; 905; 1005; 1105) that is provided such that an additional tensile stress is created within the bending system (205; 405; 500; 600*a*; 600*b*; 600*c*; 905; 1005; 1105) for the bendings beyond the upper end of the threshold angle range and that the bending stiffness is thus increased.

7. Supporting element (200; 400; 500) according to the preceding example, wherein the bending system (205; 405; 500; 905; 1005) comprises a first bending element (210; 410; 510; 910; 1010) and a second bending element (220; 420; 520; 920; 1020) which are arranged such that they engage with each other for the bendings beyond the upper end of the threshold angle range in order to create the additional tensile stress.

8. Supporting element (200; 400; 500) according to the preceding example, wherein the first bending element (210; 410; 510; 910; 1010) comprises at least one protrusion (215; 415; 515; 915; 1015) that is arranged in a recess (226; 426; 525; 926; 1026) of the second bending element (220; 420; 520; 920; 1020) and that abuts on an edge of the recess (226; 426; 525; 926; 1026) in a force-fit manner for the bendings beyond the upper end of the threshold angle range.

9. Supporting element (200; 400; 500) according to any one of the two preceding examples, wherein the first (210; 410; 510; 910; 1010; 1110) and the second (220; 420; 520; 920; 1020; 1120) bending element are provided as two flexible metal plates.

10. Supporting element (200; 400) according to any one of examples 6-9, wherein the bending system (205; 405; 905; 1105) comprises a first securing device (211; 221; 411; 421; 911; 921) and a second securing device (212; 222; 412; 422; 912; 922; 1112; 1122), wherein the first securing device (211; 221; 411; 421; 911; 921) is arranged such that it prevents a movement of the bending system (205; 405; 905; 1105) relative to the first securing device (211; 221; 411; 421; 911; 921) and wherein the second securing device (212; 222; 412; 422; 912; 922; 1112; 1122) is arranged such that it allows a movement of the bending system (205; 405; 905; 1105) relative to the second securing device (212; 222; 412; 422; 912; 922; 1112; 1122) for a bending up to the upper end of the threshold angle range and prevents the movement for the bendings beyond the upper end of the threshold angle range and thus creates a tensile stress in the bending system (205; 405; 905; 1105).

11. Supporting element (200; 400) according to the preceding example, wherein the second securing device (212; 222; 412; 422; 912; 922; 1112; 1122) is arranged within an opening (218; 228; 1118; 1128) in the bending system (205; 405; 905; 1105) such that it can move substantially freely within the opening (218; 228; 1118; 1128) for a bending up to the upper end of the threshold angle range and that a further movement is prevented by an edge of the opening (218; 228; 1118; 1128) for bendings beyond the upper end of the threshold angle range.

12. Supporting element (200; 400) according to example 11, wherein the opening (218; 228; 1118; 1128) in the bending system (205; 405; 905; 1105) is provided as an elongated hole.

13. Supporting element (600*a*; 600*b*; 600*c*) according to example 6, wherein the bending system (600*a*; 600*b*; 600*c*) comprises a rope element (625*a*; 625*b*; 625*c*), wherein the rope element (625*a*; 625*b*; 625*c*) is subject to a first tensile stress for bendings up to the upper end of the threshold angle range and wherein the rope element (625*a*; 625*b*; 625*c*) is subject to a second tensile stress, which is greater than the first tensile stress, for bendings beyond the upper end of the threshold angle range.

14. Supporting element (600*a*; 600*b*; 600*c*) according to the preceding example, wherein the first tensile stress in 0.

15. Supporting element (700) according to any one of examples 1-5, wherein the supporting element (700) comprises a bending system (700) that is provided such that for the bendings beyond the upper end of the threshold angle range an additional compressive stress is created within the bending system (700) and that the bending stiffness is thus increased.

16. Supporting element (700) according to the preceding example, wherein the bending system (700) comprises a first pressure element (710) and a second pressure element (720) that are arranged such that they are pressed onto each other for the bendings beyond the upper end of the threshold angle range in order to create the additional compressive stress.

17. Supporting element (200; 400; 500; 600*a*; 600*b*; 600*c*; 700) according to any one of the preceding examples, wherein the threshold angle range is a first threshold angle range and wherein the supporting element (200; 400; 500; 600*a*; 600*b*; 600*c*; 700) is further provided such that it comprises a third bending stiffness, which is greater than the second bending stiffness, for bendings beyond an upper end of a second threshold angle range, and wherein the second threshold angle range extends across larger angles, measured relative to the initial unbent state, than the first threshold angle range.

18. Supporting element (200; 400; 500; 600*a*; 600*b*; 600*c*; 700) according to any one of the preceding examples, wherein the supporting element (200; 400; 500; 600*a*; 600*b*; 600*c*; 700) comprises at least one of the following materials: spring steel, polyoxymethylene, polyamide, glass fibers.

19. Sole (300; 540; 640*a*; 640*b*; 640*c*; 740) for a shoe (550; 650*a*; 650*b*; 650*c*; 750; 800), in particular a soccer shoe or an American football shoe, with a supporting element (200; 400; 500; 600*a*; 600*b*; 600*c*; 700) according to any one of the preceding examples.

20. Shoe (550; 650*a*; 650*b*; 650*c*; 750; 800), in particular soccer shoe or American football shoe, with a sole (300; 540; 640*a*; 640*b*; 640*c*; 740) according to the preceding example.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A supporting element for a shoe comprising:

a first end configured to connect to a sole of the shoe;

a first securing device at the first end and extending through the first end, the first securing device fixedly clamping the first end;

a second end opposite the first end and configured to be disconnected from the sole of the shoe;

a second securing device at the second end and extending through the second end, the second end slidably movable relative to the second securing device, wherein a bending angle of the support element comprises an angle of displacement of the second end relative to the first end;

a first bending stiffness for bendings at bending angles from an initial unbent state up to an upper end of a threshold angle range; and a second bending stiffness for bendings at bending angles beyond the upper end of the threshold angle range, wherein the second bending stiffness is greater than the first bending stiffness.

2. The supporting element according to claim 1, wherein the threshold angle range is approximately 10° to 30° measured relative to the initial unbent state.

3. The supporting element according to claim 1, wherein a ratio of the second bending stiffness to the first bending stiffness is approximately 1.1:1 to 4:1.

4. The supporting element according to claim 1, wherein the first bending stiffness and the second bending stiffness each correlates to a bending stiffness of the supporting element along a roll-off direction of a wearer's foot.

5. The supporting element according to claim 1, wherein the supporting element is provided to support a front half of a wearer's foot.

6. The supporting element according to claim 1, wherein the threshold angle range is a first threshold angle range, and wherein the supporting element is further provided such that it comprises a third bending stiffness, which is greater than the second bending stiffness, for bendings beyond an upper end of a second threshold angle range, and wherein the second threshold angle range extends across larger angles, measured relative to the initial unbent state, than the first threshold angle range.

7. The supporting element according to claim 1, wherein the supporting element comprises at least one of spring steel, polyoxymethylene, polyamide, and glass fibers.

8. A sole for a shoe with a supporting element according to claim 1.

9. A shoe with a sole according to claim 8.

10. A supporting element for a shoe comprising:

at least one end;

a first bending element comprising a body having a first fixedly clamped end and a first detached end opposite the first fixedly clamped end;

a second bending element comprising a body having a second fixedly clamped end and a second detached end opposite the second fixedly clamped end, wherein the first fixedly clamped end and the second detached end are at the at least one end of the supporting element and the second detached end is movable relative to the first fixedly clamped end, wherein a bending angle of the support element comprises an angle of displacement of the first detached end relative to the first fixedly clamped end; and a bending system that comprises:

a first bending stiffness for bendings at bending angles from an initial unbent state up to an upper end of a threshold angle range; and a second bending stiffness and an additional tensile stress for bendings at bending angles beyond the upper end of the threshold angle range, wherein the second bending stiffness is greater than the first bending stiffness.

11. The supporting element according to claim 10, wherein the first bending element and the second bending element engage with each other for the bendings beyond the upper end of the threshold angle range in order to create the additional tensile stress.

12. The supporting element according to claim 11, wherein the first bending element comprises at least one protrusion that is arranged in a recess of the second bending element and that abuts on an edge of the recess in a force-fit manner for the bendings beyond the upper end of the threshold angle range.

13. The supporting element according to claim 11, wherein the first bending element and the second bending element are provided as two flexible metal plates.

14. The supporting element according to claim 10, wherein the bending system comprises a first securing device and a second securing device, wherein the first securing device is arranged such that it prevents a movement of the bending system relative to the first securing device, and wherein the second securing device is arranged such that it allows a movement of the bending system relative to the second securing device for a bending up to the upper end of the threshold angle range and prevents the movement for the bendings beyond the upper end of the threshold angle range and thus creates the additional tensile stress in the bending system.

15. The supporting element according to claim 14, wherein the second securing device is arranged within an opening in the bending system such that it can move substantially freely within the opening for a bending up to the upper end of the threshold angle range and that a further movement is prevented by an edge of the opening for bendings beyond the upper end of the threshold angle range.

16. The supporting element according to claim 15, wherein the opening in the bending system is provided as an elongated hole.

17. The shoe of claim 10, wherein the first bending element further comprises a first surface extending from the first fixedly clamped end to the first detached end, and wherein the second bending element further comprises a second surface extending from the second fixedly clamped end to the second detached end.

18. A shoe comprising:

a sole comprising a first portion and a second portion opposite from the first portion; and a supporting element comprising:

a protrusion; and a single body engaged with the protrusion, wherein the single body comprises:

a fixedly clamped end adjacent to the first portion of the sole, wherein the fixedly clamped end is connected to the first portion of the sole;

a detached end opposite the fixedly clamped end and adjacent to the second portion of the sole, wherein the detached end is disconnected from the second portion of the sole such that the detached end is movable relative to the second portion of the sole, wherein the single body defines an aperture extending through the body proximate to the detached end, wherein a length of the aperture is greater than a length of the protrusion, wherein the protrusion is arranged in the aperture and the single body is movable relative to the protrusion, wherein a bending angle of the support element comprises an angle of displacement of the detached end relative to the fixedly clamped end;

a first bending stiffness for bendings at bending angles from an initial unbent state up to an upper end of a threshold angle range; and a second bending stiffness for bendings at bending angles beyond the upper end of the threshold angle range, wherein the second bending stiffness is greater than the first bending stiffness.

* * * * *